US009649854B2

(12) United States Patent
Ohara

(10) Patent No.: US 9,649,854 B2
(45) Date of Patent: May 16, 2017

(54) INKJET RECORDING DEVICE AND INKJET RECORDING METHOD

(71) Applicant: MIMAKI ENGINEERING CO., LTD., Nagano (JP)

(72) Inventor: Eiichi Ohara, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/057,122

(22) Filed: Mar. 1, 2016

(65) Prior Publication Data

US 2016/0257129 A1 Sep. 8, 2016

(30) Foreign Application Priority Data

Mar. 2, 2015 (JP) ..... 2015-040774

(51) Int. Cl.

| | |
|---|---|
| ***B41J 2/505*** | (2006.01) |
| ***B41J 2/045*** | (2006.01) |
| ***B41J 2/15*** | (2006.01) |
| ***B41J 2/205*** | (2006.01) |
| ***B41J 2/21*** | (2006.01) |

(Continued)

(52) U.S. Cl.

CPC ..... *B41J 2/5056* (2013.01); *B41J 2/04551* (2013.01); *B41J 2/15* (2013.01); *B41J 2/2056* (2013.01); *B41J 2/21* (2013.01); *B41J 19/147* (2013.01); *B41J 29/393* (2013.01)

(58) Field of Classification Search

CPC ..... B41J 2/5056

See application file for complete search history.

(56) References Cited

U.S. PATENT DOCUMENTS 5,650,820 A * 7/1997 Sekine ..... B41J 11/22 346/139 R 6,273,550 B1 8/2001 Brown (Continued)

FOREIGN PATENT DOCUMENTS

| | | |
|---|---|---|
| JP | 2001-315317 | 11/2001 |
| JP | 2004-066468 | 3/2004 |

OTHER PUBLICATIONS

"Search Report of Europe Counterpart Application", issued on Aug. 18, 2016, p. 1-p. 7, in which the listed references were cited.

*Primary Examiner* — Alessandro Amari
*Assistant Examiner* — Roger W Pisha, II
(74) *Attorney, Agent, or Firm* — Jianq Chyun IP Office

(57) ABSTRACT

Provided is an inkjet recording device and an inkjet recording method that can selectively perform a high-speed recording mode or a high-quality recording mode without requiring a process of changing configurations of nozzle rows. The head control section performs the discharge control by using all the nozzles belonging to the nozzle groups of respective colors as the usable range Ru in the case where the "high-speed mode" is designated by the mode designating section. On the other hand, in the case where the "high-quality mode" is designated, the head control section determines, for each color, the usable range Ru being a part of the nozzle range Rn configured by the nozzle groups, and performs the discharge control using only the nozzles belonging to the usable ranges Ru so as to cause the ink droplets to be discharged according to the particular color order at any positions on the recording medium.

18 Claims, 17 Drawing Sheets

(51) Int. Cl.
*B41J 19/14* (2006.01)
*B41J 29/393* (2006.01)

(56) References Cited

U.S. PATENT DOCUMENTS

| | | | | |
|---|---|---|---|---|
| 2002/0154182 | A1* | 10/2002 | Takahashi | B41J 2/2132 347/12 |
| 2011/0187774 | A1* | 8/2011 | Kakinuma | B41J 29/38 347/12 |
| 2012/0081461 | A1 | 4/2012 | Kakutani | |

* cited by examiner

| | | | | | | | |
|---|---|---|---|---|---|---|---|
| A1 | | A1 | | A1 | | A1 | |
| | | | | | | | |
| B1 | | B1 | | B1 | | B1 | |
| | | | | | | | |
| A1 | | A1 | | A1 | | A1 | |
| | | | | | | | |
| B1 | | B1 | | B1 | | B1 | |
| | | | | | | | |

FIG. 7A

| | | | | | | | |
|---|---|---|---|---|---|---|---|
| A1 | | A1 | | A1 | | A1 | |
| | B2 | | B2 | | B2 | | B2 |
| B1 | | B1 | | B1 | | B1 | |
| | A2 | | A2 | | A2 | | A2 |
| A1 | | A1 | | A1 | | A1 | |
| | B2 | | B2 | | B2 | | B2 |
| B1 | | B1 | | B1 | | B1 | |
| | A2 | | A2 | | A2 | | A2 |

FIG. 7B

| | | | | | | | |
|---|---|---|---|---|---|---|---|
| A1 | C3 | A1 | C3 | A1 | C3 | A1 | C3 |
| D4 | B2 | D4 | B2 | D4 | B2 | D4 | B2 |
| B1 | D3 | B1 | D3 | B1 | D3 | B1 | D3 |
| C4 | A2 | C4 | A2 | C4 | A2 | C4 | A2 |
| A1 | C3 | A1 | C3 | A1 | C3 | A1 | C3 |
| D4 | B2 | D4 | B2 | D4 | B2 | D4 | B2 |
| B1 | D3 | B1 | D3 | B1 | D3 | B1 | D3 |
| C4 | A2 | C4 | A2 | C4 | A2 | C4 | A2 |

FIG. 7C

| | | | | | | | |
|---|---|---|---|---|---|---|---|
| A1 | | A1 | | A1 | | A1 | |
| | | | | | | | |
| B1 | | B1 | | B1 | | B1 | |
| | | | | | | | |
| A1 | | A1 | | A1 | | A1 | |
| | | | | | | | |
| B1 | | B1 | | B1 | | B1 | |
| | | | | | | | |

FIG. 9A

| | | | | | | | |
|---|---|---|---|---|---|---|---|
| A1 | | A1 | | A1 | | A1 | |
| | B2 | | B2 | | B2 | | B2 |
| B1 | | B1 | | B1 | | B1 | |
| | A2 | | A2 | | A2 | | A2 |
| A1 | | A1 | | A1 | | A1 | |
| | B2 | | B2 | | B2 | | B2 |
| B1 | | B1 | | B1 | | B1 | |
| | A2 | | A2 | | A2 | | A2 |

FIG. 9B

| | | | | | | | |
|---|---|---|---|---|---|---|---|
| A1 | A3 | A1 | A3 | A1 | A3 | A1 | A3 |
| B4 | B2 | B4 | B2 | B4 | B2 | B4 | B2 |
| B1 | B3 | B1 | B3 | B1 | B3 | B1 | B3 |
| A4 | A2 | A4 | A2 | A4 | A2 | A4 | A2 |
| A1 | A3 | A1 | A3 | A1 | A3 | A1 | A3 |
| B4 | B2 | B4 | B2 | B4 | B2 | B4 | B2 |
| B1 | B3 | B1 | B3 | B1 | B3 | B1 | B3 |
| A4 | A2 | A4 | A2 | A4 | A2 | A4 | A2 |

FIG. 9C

| | | | | | | | |
|---|---|---|---|---|---|---|---|
| | | | | | | | |
| C5 | | D5 | | C5 | | D5 | |
| | | | | | | | |
| C5 | | D5 | | C5 | | D5 | |
| | | | | | | | |
| C5 | | D5 | | C5 | | D5 | |

FIG. 10A

| | | | | | | | |
|---|---|---|---|---|---|---|---|
| C5 | | D6 | | C5 | | D6 | |
| | D6 | | D6 | | D6 | | C6 |
| D5 | | D5 | | C5 | | D5 | |
| | D6 | | D6 | | D6 | | C6 |
| C5 | | D5 | | C5 | | D5 | |
| | D6 | | D6 | | D6 | | C6 |
| C5 | | D5 | | C5 | | D5 | |
| | D6 | | D6 | | D6 | | C6 |

FIG. 10B

| | | | | | | | |
|---|---|---|---|---|---|---|---|
| C5 | C7 | C5 | C7 | C5 | C7 | C5 | C7 |
| D8 | D6 | D8 | D6 | D8 | D6 | D8 | D6 |
| D5 | D7 | D5 | D7 | D5 | D7 | D5 | D7 |
| C8 | C6 | C8 | C6 | C8 | C6 | C8 | C6 |
| C5 | C7 | C5 | C7 | C5 | C7 | C5 | C7 |
| D8 | D6 | D8 | D6 | D8 | D6 | D8 | D6 |
| D5 | D7 | D5 | D7 | D5 | D7 | D5 | D7 |
| C8 | C6 | C8 | C6 | C8 | C6 | C8 | C6 |

FIG. 10C

INKJET RECORDING DEVICE AND INKJET RECORDING METHOD

CROSS REFERENCE TO RELATED APPLICATIONS

This application claims the priority benefit of Japanese Patent Application No. 2015-040774, filed on Mar. 2, 2015. The entirety of the above-mentioned patent application is hereby incorporated by reference herein and made a part of this specification.

TECHNICAL FIELD

The present disclosure relates to an inkjet recording device and an inkjet recording method that form an image on a recording medium using ink.

DESCRIPTION OF THE BACKGROUND ART

Conventionally, in the field of industrial printing, inkjet recording devices that form images on recording media by discharging ink droplets from nozzle rows has been developed. Especially, various techniques regarding the arrangements of the nozzle rows are being proposed for achieving high-speed or high-image-quality recording.

Patent Document 1 proposes a device configuration provided with a head holder for detachably retaining a plurality of recording heads with different ink droplet colors or nozzle intervals on a carriage configured to be capable of reciprocal scanning. Further, it is described that a recording head to be actually used is selected from among the plurality of recording heads retained on the head holder according to a designated recording mode.

Patent Document 2 proposes a recording head having a plurality of nozzle groups arranged as one unit symmetrically about a center line in an arranged direction of the nozzle groups, with colors arranged in order of decreasing visibility of color shift from the side closer to this center line.

[Patent Document 1] JP 2001-315317 A (Abstract, FIG. 5, FIG. 6, etc.)

[Patent Document 2] JP 2004-066468 A (Abstract)

SUMMARY

Now, a worker normally performs a plurality of print jobs while selecting an optimal recording mode according to a required specification (quality, production cost, and due date) of resulting products. In so doing, depending on the situation of incoming orders, a situation may occur where the recording mode needs to be changed frequently.

However, in the device proposed in Patent Document 1, the recording head needs to be detached and attached each time the recording mode is changed, so the work becomes extremely complicated. Further, upon an attaching work, if a position and a posture of the recording head had not been adjusted suitably, an accuracy of striking positions of the ink droplets discharged from that recording head is reduced. Accordingly, there is a concern on a decrease in an image quality and appearance quality of the resulting product.

The present disclosure has been made in view of the above problem, and aims to provide an inkjet recording device and an inkjet recording method that can selectively perform a high-speed recording mode or a high-quality recording mode without requiring a process of changing configurations of nozzle rows.

Solutions to Problem

An inkjet recording device of the present disclosure includes: a recording unit that is reciprocally movable along a main-scanning direction relative to a recording medium, and the recording unit includes a plurality of nozzles for discharging ink droplets; a moving mechanism that moves the recording unit and the recording medium relatively in a sub-scanning direction that is a direction intersecting the main-scanning direction; a head control section that performs a discharge control of the recording unit while the moving mechanism relatively moves the recording unit and the recording medium; and a mode designating section that designates one of a plurality of recording modes different from the discharge control, and the plurality of recording modes including a first recording mode and a second recording mode, wherein when a set of two or more nozzles that are arranged along the sub-scanning direction and discharge ink droplets of a same color is defined as one nozzle group, the recording unit including at least two nozzle groups that discharge ink droplets of at least two colors, in a case where the first recording mode is designated by the mode designating section, the head control section performs the discharge control by using all of the nozzles belonging to the nozzle group of each color as a usable range, and in a case where the second recording mode is designated by the mode designating section, the head control section determines, for each color, a usable range being a part of a nozzle range configured by the nozzle group, and performs the discharge control by using only the nozzles belonging to the usable range, so that ink droplets are discharged at any positions on the recording medium according to a particular color order.

As above, since the head control section performs the discharge control using all of the nozzles belonging to the nozzle group of each color when the first recording mode is designated, a total number of discharged ink droplets is maximized in moving the recording unit once along the main-scanning direction. That is, the desired image is formed at high speed by designating the first recording mode that uses the largest number of nozzles.

Further, in the case where the second recording mode is designated, since the head control section performs the discharge control using only the nozzles belonging to the usable range being a part of the nozzle range, such a design is enabled that both a population of the nozzles of the same color and a positional relationship among the nozzles of different colors in the sub-scanning direction are taken into account. That is, by designating the second recording mode that uses the part of the nozzles, a high-quality image is formed while microscopic physical phenomenon among the same color and different colors is taken into consideration.

Due to this, the high-speed recording mode or the high-quality recording mode can selectively be performed without requiring the work to change the configuration of the nozzle rows.

Further, preferably the recording unit includes at least two nozzle groups that discharge ink droplets of at least two colors with different brightness, the moving mechanism moves the recording unit and the recording medium relatively from an upstream side only to a downstream side in the sub-scanning direction, and in a case where the second recording mode is designated, the head control section determines the usable range located on the uppermost stream side in the sub-scanning direction for a color with lower brightness than the brightness of the at least one other color, so that the ink droplets of the color with the lowest brightness are discharged first. Due to this, in the case of forming an image by layering dots on a recording medium, dots of a color with relatively low brightness are arranged in the lowermost layer. In other words, by arranging dots of a color with the highest visibility at positions separated away from the uppermost layer of the image, a high-quality image with reduced noise and reduced granularity can be obtained.

Further, preferably the recording unit includes at least three nozzle groups with different positions in the main-scanning direction, at least two nozzle groups among the at least three nozzle groups discharge ink droplets of a common color, and with a center line between two lines formed by the nozzle groups that are farthest away in the main-scanning direction as a reference, the nozzle group closest to the center line discharges the ink droplets of the color with lower brightness than the brightness of the at least one other color, and the two nozzle groups that are farthest away in the main-scanning direction discharge the ink droplets of the color with higher brightness than the brightness of the at least one other color. By arranging the respective nozzle groups as above, the ink droplets of the color with relatively low brightness can be prevented from being discharged last at any position on the recording medium. As a result, the dots of the color with relatively high visibility are less likely to be arranged in the uppermost layer of the image, resulting in less noise and less granularity of the image.

Further, preferably the recording unit is configured by arranging a plurality of recording heads along the sub-scanning direction, and each of the recording heads includes nozzle rows configuring the nozzle group, and has the nozzle rows that discharge the ink droplets of at least two common colors and are arranged along the main-scanning direction in a common color order. By arranging the plurality of recording heads along the sub-scanning direction, the number of nozzles to be provided in each recording head can be made less, resulting in improved productivity of the recording heads (for example, yield).

Further, preferably, in the case where the second recording mode is designated, the head control section determines the usable range in nozzle row units for each color, and performs the discharge control. Displacements in positions and postures tend to occur among adjacent recording heads, leading to discontinuity among the nozzle rows. Thus, by determining the usable range in nozzle row units, irregularities in striking positions of the ink droplets of the same color can be suppressed, and a high-quality image can be obtained.

Further, preferably, in the case where the second recording mode is designated, the head control section uses only the nozzle row of the recording head positioned on the uppermost stream side in the sub-scanning direction to cause the ink droplets of the color with the lowest brightness to be discharged first. Due to this, irregularities in striking positions of the ink droplets of the color with the highest visibility become less conspicuous, and in addition, the dots with low brightness are less likely to be arranged in the uppermost layer of the image, and thus an image with even greater vividness can be obtained.

Further, preferably, in the case where the second recording mode is designated, the head control section determines the usable range positioned at the lowermost stream side in the sub-scanning direction for the color with the highest brightness so that the ink droplets of the color with the highest brightness are discharged last. In a case of forming an image by layering dots on a recording medium, dots of a color with the highest brightness are arranged in the uppermost layer of the image. In other words, by arranging dots of other colors with relatively high visibility at positions distant from the uppermost layer of the image, a high-quality image with reduced noise and reduced granularity by dots of a conspicuous color can be obtained.

Further, preferably, in the case where the second recording mode is designated, the head control section determines the usable range having the same number of nozzles to be used for all of the dischargeable colors, and performs the discharge control.

Further, preferably, in the case where the second recording mode is designated, the head control section determines the usable range having a different number of nozzles to be used for at least one color among all of the dischargeable colors, and performs the discharge control.

An inkjet recording method of the present disclosure is a method in which an inkjet recording device is used, the inkjet recording device including: a recording unit that is reciprocally movable along a main-scanning direction relative to a recording medium, and the recording unit includes a plurality of nozzles for discharging ink droplets; and a moving mechanism that moves the recording unit and the recording medium relatively in a sub-scanning direction that is a direction intersecting the main-scanning direction, the inkjet recording device being configured to perform a discharge control of the recording unit while the moving mechanism relatively moves the recording unit and the recording medium, the recording unit including at least two nozzle groups when a set of two or more nozzles that are arranged along the sub-scanning direction and discharge ink droplets of a same color is defined as one nozzle group, wherein the inkjet recording method including: a designating step of designating one of a plurality of recording modes different from the discharge control, and the plurality of recording modes including a first recording mode and a second recording mode; and a controlling step of, in a case where the first recording mode is designated, performing the discharge control by using all of the nozzles belonging to the nozzle group of each color as a usable range and, in a case where the second recording mode is designated, determining, for each color, a usable range being a part of a nozzle range configured by the nozzle group, and performing the discharge control by using only the nozzles belonging to the usable range to cause ink droplets to be discharged at any positions on the recording medium according to a particular color order.

According to the inkjet recording device and the inkjet recording method of the present disclosure, an inkjet recording device and an inkjet recording method that can selectively perform the high-speed recording mode or the high-quality recording mode without requiring the process of changing the configurations of the nozzle rows can be provided.

BRIEF DESCRIPTION OF DRAWINGS

FIGS. 7A to 7C are schematic diagrams illustrating striking positions of "black" ink droplets in the high-speed mode for each pass.

FIGS. 9A to 9C are schematic diagrams illustrating striking positions of the "black" ink droplets in the high-quality mode (first example) for each pass.

FIGS. 10A to 10C are schematic diagrams illustrating striking positions of "yellow" ink droplets in the high-quality mode (first example) for each pass.

DETAILED DESCRIPTION OF EMBODIMENTS

Hereinbelow, an inkjet recording device of the present disclosure will be described with reference to the attached drawings by providing suitable embodiments in relation to an inkjet recording method. In this specification, forming an image is in some cases referred to as "recording, printing, or text-printing".

[Configuration of Inkjet Recording Device 10]

<Entire Configuration>

Figure 1:
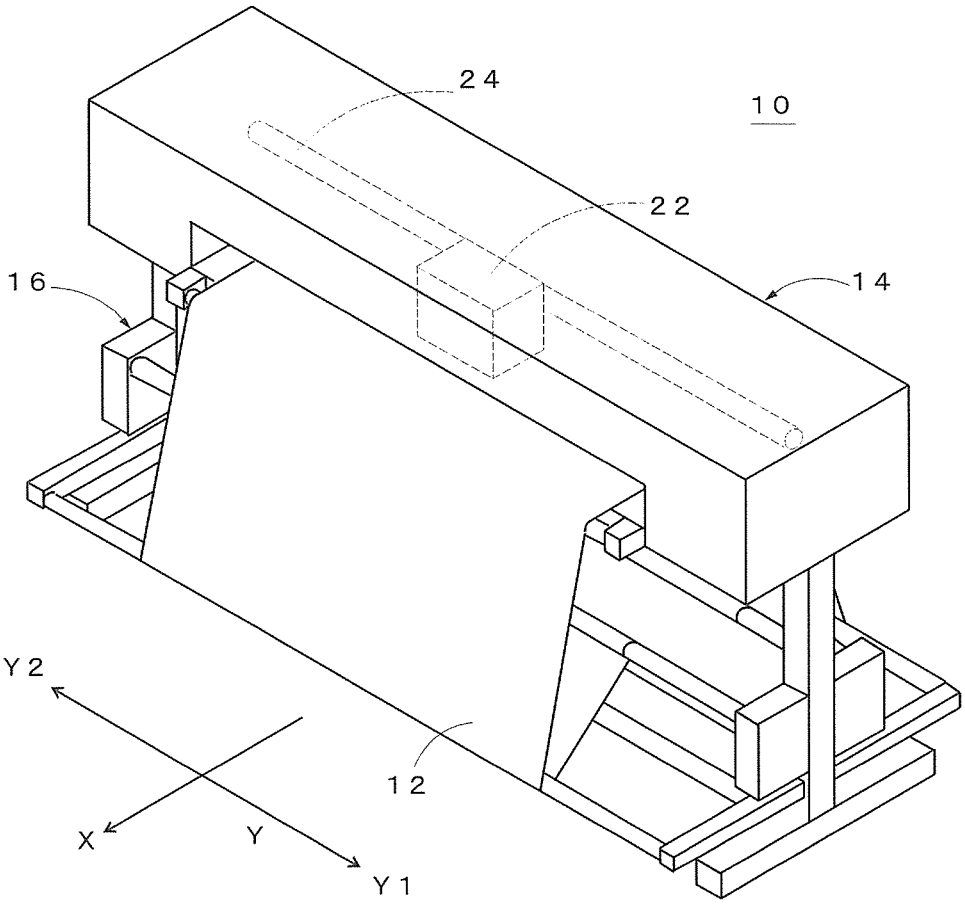
FIG. 1 is a perspective view of an inkjet recording device according to an embodiment.
Figure 2:
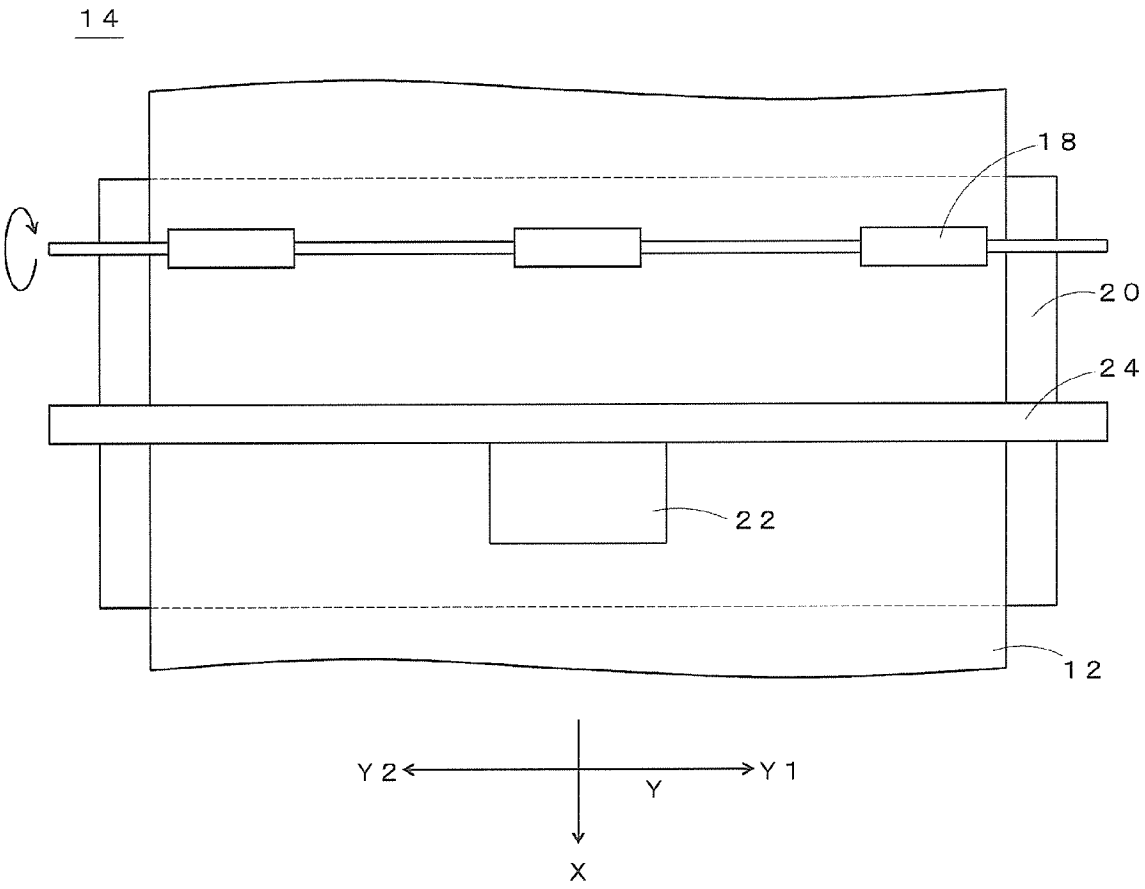
FIG. 2 is an enlarged plan view of a primary part of the inkjet recording device illustrated in FIG. 1.

FIG. 1 is a perspective view of an inkjet recording device 10 according to an embodiment. FIG. 2 is an enlarged plan view of a primary part of the inkjet recording device 10 illustrated in FIG. 1.

This inkjet recording device 10 is a wide format printer that forms a color image on a recording medium 12 using ultraviolet curable ink. A medium made of various types of materials, including paper, non-woven fabric, vinyl chloride, synthetic chemical fiber, polyethylene, polyester, and tarpaulin (regardless of their permeability and impermeability) may be adapted as the recording medium 12.

As shown in FIG. 1 and FIG. 2, the inkjet recording device 10 basically includes a device main body 14 that performs a printing process on a roll-shaped recording medium 12, and a winding device 16 that winds up the recording medium 12 that had undergone the printing process. The device main body 14 includes transfer rollers 18 (moving mechanism) that move and transfer the recording medium 12 in an X-direction, a platen 20 that supports the recording medium 12, being transferred by rotation of the transfer rollers 18, from below, a carriage section 22 arranged above the platen 20 while being separated therefrom, and a guide rail 24 that supports the carriage section 22 drivably along a Y-direction (i.e., Y1 and Y2 as shown in related figures) that intersects with the X-direction.

Figure 3:
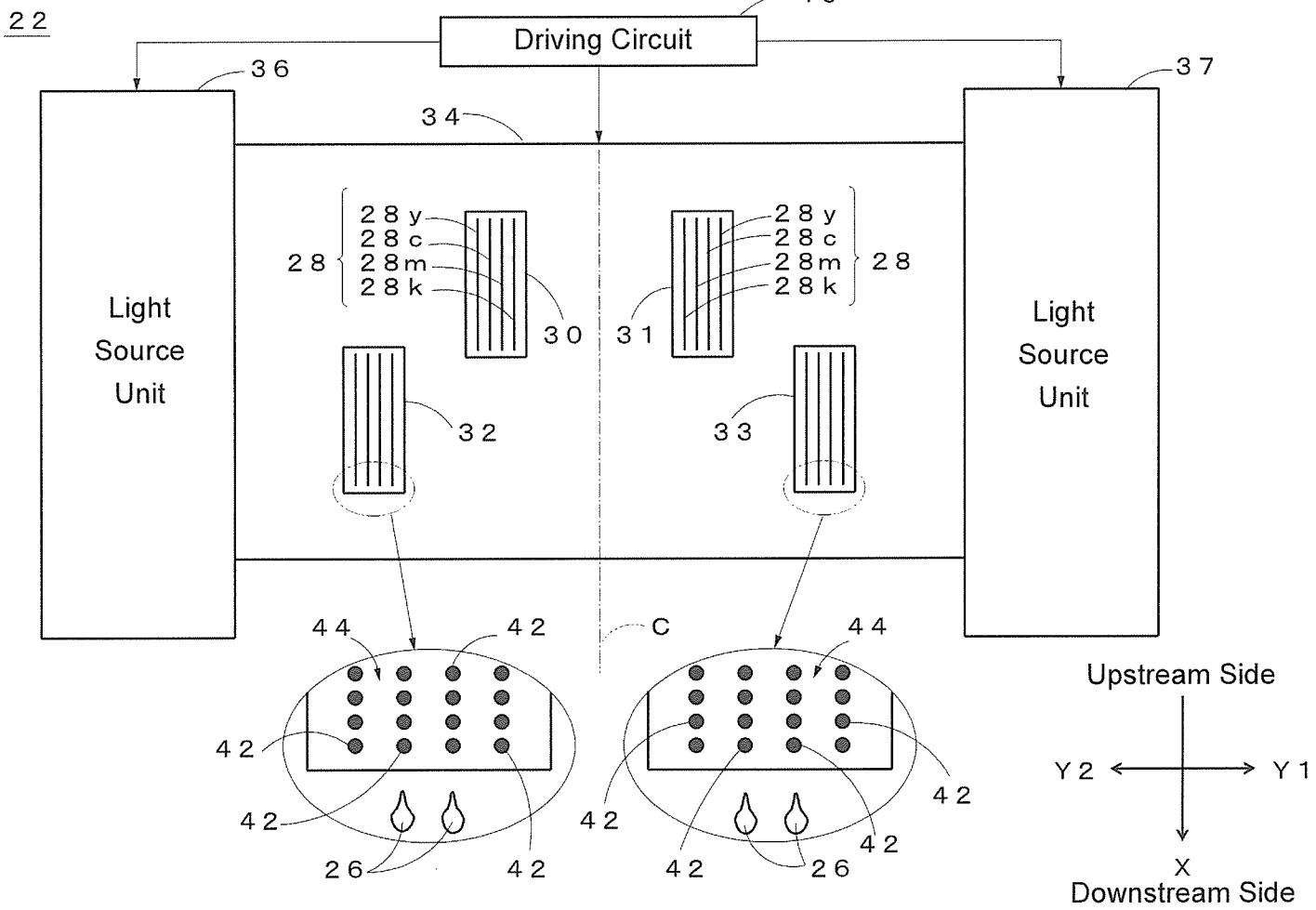
FIG. 3 is a schematic see-through plan view of a carriage section illustrated in FIG. 1 and FIG. 2.

The inkjet recording device 10 employs a so-called multi-pass (or, shuttle pass) recording scheme. The "multi-pass recording scheme" is a recording scheme that completes an image by discharging liquid droplets of ink (hereinbelow ink droplets 26; FIG. 3) a plurality of times onto the same position on the recording medium 12 (image region with a predetermined width) while the recording medium 12 is moved in a sub-scanning direction (X-direction) and the carriage section 22 is moved in a main-scanning direction (Y-direction). In this embodiment, the Y-direction corresponding to the main-scanning direction intersects perpendicularly to the X-direction that corresponds to the sub-scanning direction.

<Configuration of Carriage Section 22>

FIG. 3 is a schematic see-through plan view of a carriage section 22 illustrated in FIG. 1 and FIG. 2. A housing of the carriage section 22 fixedly houses four recording heads 30, 31, 32, 33 including nozzle rows 28 that discharge ink droplets 26, a head holder 34 that has a rectangular shape in planar view and retains all of the recording heads 30 to 33, and light source units 36, 37 arranged on both sides of the head holder 34.

Hereinbelow, the plurality of recording heads 30 to 33 and the head holder 34 will be collectively termed a recording unit 38. Further, for the sake of convenience of explanation, additional letters (cmyk) are added to the reference number (28) of the nozzle rows in some cases to make distinction.

The recording heads 30 to 33 and the light source units 36, 37 are connected electrically to a driving circuit 40 provided in the device main body 14. The driving circuit 40 is an electrical circuit that performs a discharge control of the recording heads 30 to 33 and an irradiation control of the light source units 36, 37.

Each of the recording heads 30 to 33 discharges the ink droplets 26 of four colors (CMYK) from the four respective nozzle rows 28 extending in the X-direction. Various types of schemes may be employed as a discharging mechanism of the ink droplets 26 from the recording heads 30 to 33. For example, a scheme in which the ink droplets 26 are discharged by deformation of an actuator including piezoelectric elements may be adapted. Further, a scheme in which air bubbles are generated by heating the ink by a heater (heat generator), and the ink droplets 26 are discharged by a pressure thereof may be adapted.

The light source units 36, 37 each emit ultraviolet rays toward the ink droplets 26 on the recording medium 12, and have a substantially rectangular shape in planar view. Light sources for emitting the ultraviolet rays are configured of rare-gas discharge lamps, mercury discharge lamps, fluorescent lamps, LED (Light Emitting Diode) arrays and the like.

Nozzle rows 28*y* of the recording heads 30 to 33 are configured of a plurality of nozzles 42 arranged at regular intervals for discharging yellow (Y) ink droplets 26. Nozzle rows 28*c* are configured of a plurality of nozzles 42 arranged at regular intervals for discharging cyan (C) ink droplets 26. Nozzle rows 28*m* are configured of a plurality of nozzles 42 arranged at regular intervals for discharging magenta (M) ink droplets 26. Nozzle rows 28*k* are configured of a plurality of nozzles 42 arranged at regular intervals for discharging black (K) ink droplets 26. Hereinbelow, a set of nozzles 42 arranged in two-dimensional matrix is in some cases referred to as a "nozzle matrix 44".

<Arrangement Relationship of Recording Heads 30 to 33>

Figure 4:
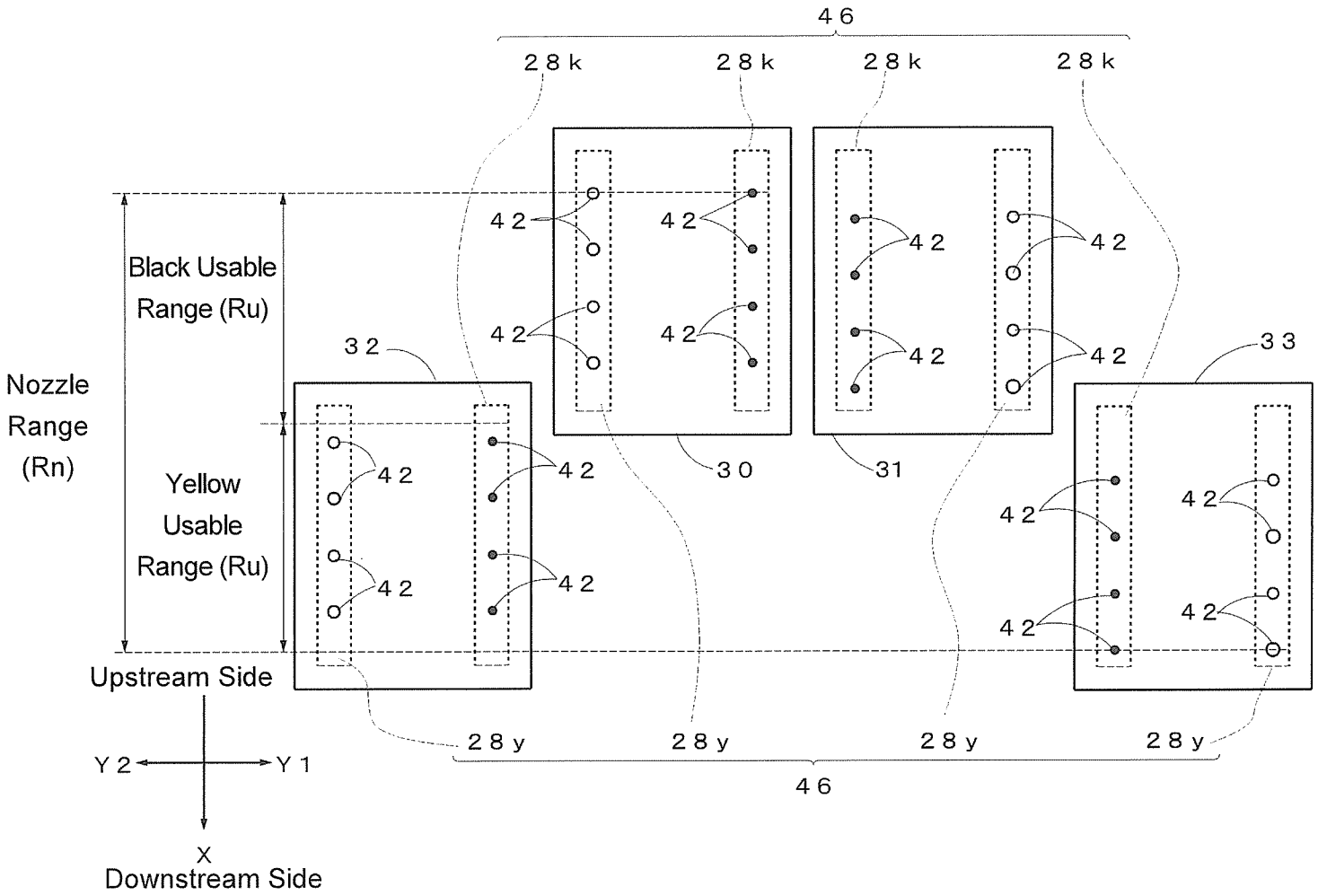
FIG. 4 is a schematic view illustrating an arrangement relationship of a plurality of recording heads.

FIG. 4 is a schematic view illustrating an arrangement relationship of the plurality of recording heads 30 to 33. For the sake of convenience of description, only two types of nozzle rows 28*y*, 28*k* are illustrated, and indication of the rest of nozzle rows 28*c*, 28*m* is omitted.

The recording heads 30, 31 are arranged so as to be symmetric relative to a center line C illustrated by a one-dot chain line. The center line C is located at a center of two lines formed by the nozzle rows 28*y*, 28*y*, which are farthest in the Y-direction. The recording heads 32, 33 are similarly arranged so as to be symmetric relative to the center line C. Further, for all of the recording heads 30 to 33, the nozzle row 28*k* of the color with the low brightness (black) is arranged at a position closest to the center line C, and the nozzle row 28*y* of the color with high brightness (yellow) is arranged at a position farthest away from the center line C. Notably, the "brightness" in the specification denotes how bright a color is, and for example, it is an index that takes a value of one of 0 to 100 in a color system including CIELAB, CIELUV.

Two recording heads 30, 32 are arranged in a staggered arrangement (so-called zigzag arrangement) in two alternate rows along the X-direction. Further, the two recording heads 30, 32 are configured of the nozzle rows 28 that discharge the ink droplets 26 of at least two common colors and are arranged in a common color order along the Y-direction. Due to this, the nozzles 42 configuring two nozzle rows 28, 28 are arranged at regular intervals in regards to their positions in the X-direction. Accordingly, by arranging the plurality of recording heads 30, 32 by displacing them in the Y-direction, a printing region (width in the X-direction) that can be obtained by one scan of the carriage section 22 can be enlarged. Similarly, the aforementioned arrangement relationship applies to two recording heads 31, 33 as well.

Further, the position of nozzle 42 of the recording head 31 is arranged on the downstream side in the X-direction by a half of the interval (one pitch) relative to the position of nozzle 42 of the recording head 30. By arranging the plurality of recording heads 30, 31 while displacing the positions of nozzles 42 slightly in the X-direction in such a manner, recording can be performed at a substantially doubled recording resolution. Similarly, the aforementioned arrangement relationship applies to the two recording heads 32, 33 as well.

By the above configuration, one nozzle group 46 that discharges the black ink droplets 26 is present, and one nozzle group 46 that discharges the yellow ink droplets 26 is present. Here, the "nozzle group" refers to a set of two or more nozzles 42 that are arranged along the X-direction and discharge the ink droplets 26 of the same color. Notably, the same applies to the other two colors, that is, for cyan and magenta of which illustration in the drawings is omitted.

Hereinbelow, in the present specification, a range covered by all of the nozzles 42 configuring a nozzle group 46 will be termed a "nozzle range Rn". Further, a range that is a part of or all of the nozzle range Rn and covered by a nozzle row to be used in a discharge control of the ink droplets 26 (which may also be termed an nozzle row to be used) will be termed a "usable range Ru". The usable range Ru includes nozzles 42 that discharge the ink droplets 26 and nozzles 42 that do not discharge the ink droplets 26 according to settings on discharge duty or a discharge control mask.

<Electrical Block Diagram>

Figure 5:
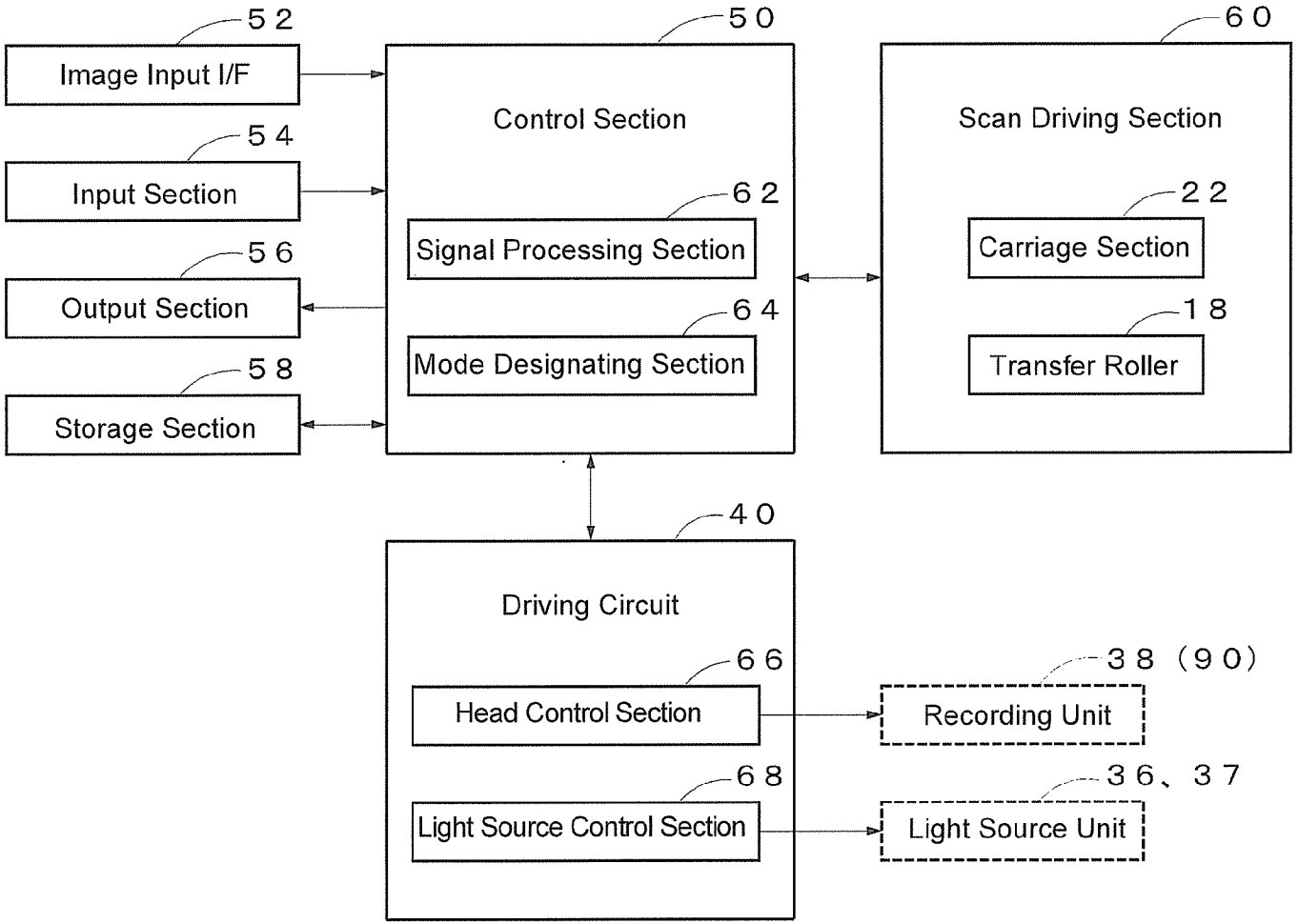
FIG. 5 is an electrical block diagram of the inkjet recording device illustrated in FIG. 1.

FIG. 5 is an electrical block diagram of the inkjet recording device 10 illustrated in FIG. 1. The inkjet recording device 10 includes not only the light source units 36, 37, the recording unit 38, and the driving circuit 40 (see FIG. 3 for all of these), but also a control section 50, an image input I/F 52, an input section 54, an output section 56, a storage section 58, and a scan driving section 60.

The image input I/F 52 is configured of a serial I/F or a parallel I/F, and receives electric signals indicative of image information (hereinbelow image signals) from an external device that is not illustrated. The input section 54 includes a mouse, a keyboard, a touch panel, or a microphone. The output section 56 includes a display or a speaker. The storage section 58 is configured of a computer-readable storage medium, more specifically a memory device.

The scan driving section 60 moves the recording unit 38 relatively to the recording medium 12 in the X-direction and the Y-direction. In this embodiment, the scan driving section 60 is configured of the carriage section 22 (see FIG. 2) that reciprocally moves the recording unit 38 in the Y-direction, and the transfer rollers 18 (see FIG. 2) that moves the recording medium 12 from the upstream side to the downstream side in the X-direction.

The control section 50 is configured for example of a CPU (Central Processing Unit) or a processor of an MPU (Micro-Processing Unit). The control section 50 is capable of realizing respective functions, including a signal processing section 62 and a mode designating section 64, by reading and executing a program stored in the storage section 58.

The signal processing section 62 generates an intermediate signal (hereinbelow, dot signal) indicative of presence and absence of dots and arrangements thereof by performing desired image processing on the image signal inputted through the image input I/F 52. Thereafter, the signal processing section 62 finally generates control signals to be supplied for the discharge control of the ink droplets 26 based on the dot signals; more specifically, driving waveform signals for actuators provided in the recording heads 30 to 33.

The mode designating section 64 designates one of a plurality of recording modes, including a high-speed mode (first recording mode) and a high-quality mode (second recording mode). The "high-speed mode" and the "high-quality mode" will be described later.

The head control section 66 performs the discharge control of the recording unit 38 under the relative movement of the recording unit 38 and the recording medium 12. Specifically, the head control section 66 causes the ink droplets 26 to be discharged from the nozzle rows 28 configuring the recording unit 38 at suitable timings according to the recording mode designated by the mode designating section 64.

The light source control section 68 performs the irradiation control of the light source units 36, 37 during when the ink droplets 26 are discharged onto the recording medium 12. The light source units 36, 37 perform a post-treatment of curing the ink droplets 26 by irradiation of ultraviolet rays according to the irradiation control of the light source control section 68.

[Operation of Inkjet Recording Device 10]

The inkjet recording device 10 of this embodiment is configured as above. Now, an operation of the inkjet recording device 10 will be described with reference to FIG. 6 to FIG. 15. Here, a method of determining the usable range Ru according to recording modes will mainly be described.

Firstly, the mode designating section 64 designates one of the plurality of recording modes based on an instruction operation through the input section 54 by a worker, or on an analysis result of job information associated to the image signals. The plurality of recording modes includes the "high-speed mode" for obtaining an image at high speed, and the "high-quality mode" for obtaining a high-quality image.

<High-Speed Mode>

Figure 6:
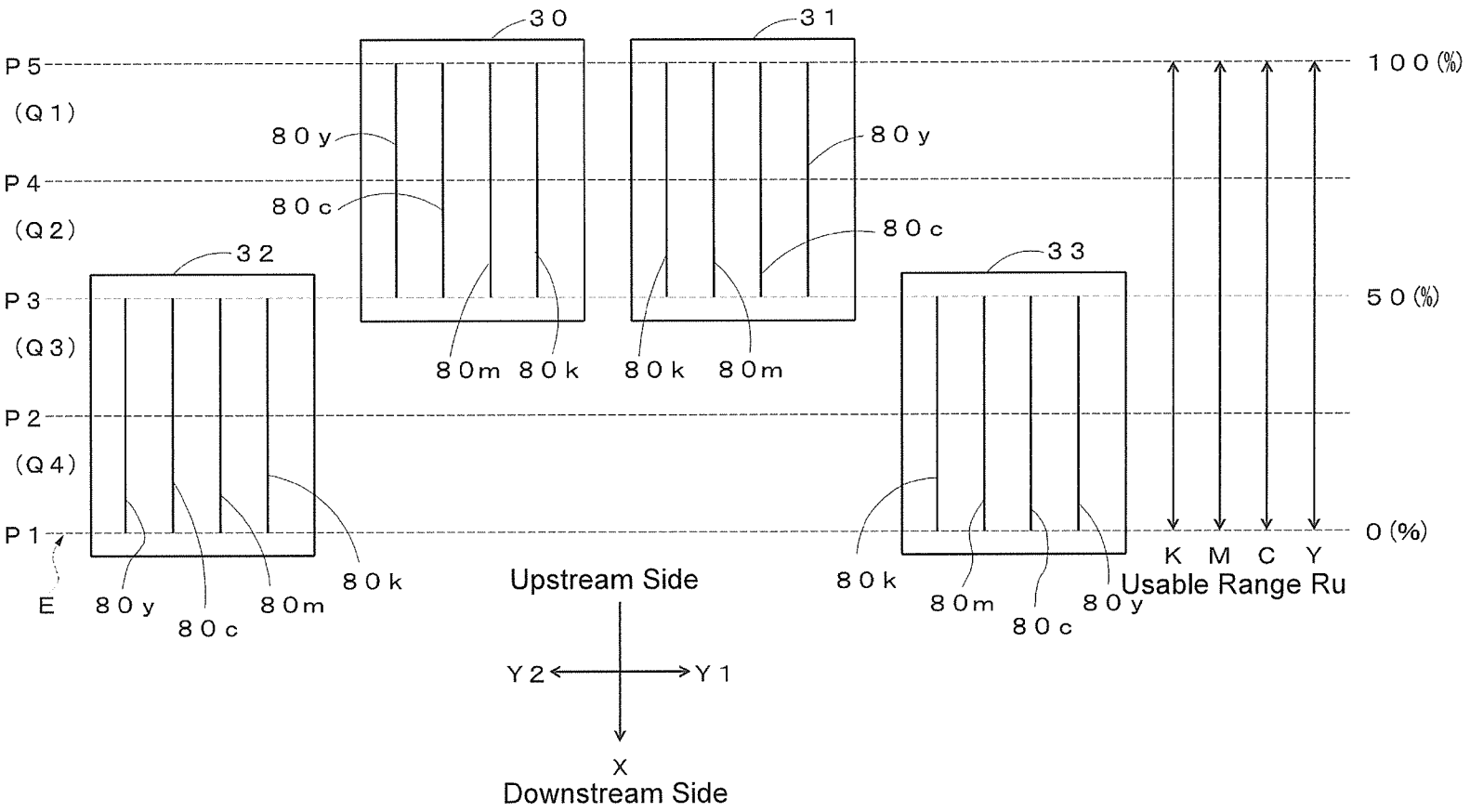
FIG. 6 is an explanatory diagram illustrating a usable range of nozzles in a high-speed mode.

FIG. 6 is an explanatory diagram illustrating the usable ranges Ru of the nozzles 42 in the high-speed mode. Among the nozzle groups 46 of the respective colors, subsets of the nozzles 42 that are actually used (that is, the nozzle rows to be used) are illustrated by solid lines. Reference numerals 80*y*, 80*c*, 80*m*, 80*k* respectively correspond to the yellow, cyan, magenta, and black nozzle rows to be used. As can be understood from FIG. 6, the usable range Ru of each color matches the nozzle range Rn (see FIG. 4), and thus all of the nozzles 42 belonging to the nozzle groups 46 of the respective colors are used.

A recording edge E illustrates positions of the nozzles 42 on the downmost stream side in the nozzle ranges Rn. Further, transfer positions Pn (n=1 to 5) illustrate positions that match the recording edge E upon a transfer of nth pass in a case of sequentially transferring the recording medium 12 along the X-direction. Further, recording ranges Qn (n=1 to 4) each correspond to a targeted range recorded by the nth-pass transfer (current position of "unit image region").

Hereinbelow, for the sake of convenience of explanation, the usable ranges Ru are expressed by using percentages with the recording edge E being the lowest limit value (0%). "100%" corresponds to positions of the nozzles 42 at the uppermost stream side within the nozzle range Rn. "50%" corresponds to positions of the nozzles 42 located at a boundary between the recording heads 31, 32. In view of this, in the high-speed mode, the usable range Ru of each color is "0% to 100%".

FIG. 7A to FIG. 7C are schematic diagrams illustrating the striking positions of the "black" ink droplets 26 in the high-speed mode for each pass. Specifically, FIG. 7A illustrates accumulative striking positions in the 1st-pass transfer, FIG. 7B illustrates the accumulative striking positions in the 2nd-pass transfer, and FIG. 7C illustrates the accumulative striking positions in the 4th-pass transfer.

A matrix configured of 64 cells illustrates a struck state of the ink droplets 26 in the unit image region. Specifically, a cell with letters corresponds to "a position where ink had struck", and a cell without letters corresponds to "a position where no ink has struck yet".

Two letters as a combination of one alphabet letter (for example, "A") and one mathematical numerical letter (for example, "1") are described in each cell. The former denotes an attribute of the recording heads 30 to 33 that are indicated by identifiers of "A", "B", "C", and "D" in an order of increasing reference number. The latter denotes the discharge timing of the ink droplet 26, and is expressed in pass number (n). For example, the left upper cell "A1" schematically denotes that the ink droplet 26 was discharged from the recording head 30 upon the 1st-pass transfer, and struck the left upper position in the unit image region (recording range Q1).

As shown in FIG. 7A, upon the 1st-pass transfer, the recording heads 30 to 33 sequentially discharge the ink droplets 26 to every other cell while moving in the Y-direction. In so doing, 16 ink droplets 26 discharged from the recording heads 30, 31 strike onto the respective positions in the matrix cells in the recording range Q1. After one scan along the Y-direction is completed, the recording medium 12 is transferred by one pass to the downstream side in the X-direction.

As shown in FIG. 7B, upon the 2nd-pass transfer, the recording heads 30 to 33 sequentially discharge the ink droplets 26 to every other cell while moving in the Y-direction. In so doing, 16 ink droplets 26 discharged from the recording heads 30, 31 strike onto the respective positions in the matrix cells in the recording range Q2. After one scan along the Y-direction is completed, the recording medium 12 is transferred by one pass to the downstream side in the X-direction.

Subsequently, upon the 3rd-pass transfer, the ink droplets 26 (16 droplets) discharged from the recording heads 32, 33 strike onto the respective positions in the matrix points in the recording range Q3. Next, upon the 4th-pass transfer, the ink droplets 26 (16 droplets) discharged from the recording heads 32, 33 strike onto the respective positions in the matrix cells in the recording range Q4. Due to this, all of the 64 cells are filled, and the image in the unit image region (band-shaped region having a one-pass worth width) is completed.

As shown in FIG. 7C, the cells containing the four types of letters, namely "A", "B", "C", "D", are arranged evenly within the matrix. That is, in order to complete the image in the unit image region, all of the four recording heads 30 to 33 are used. Accordingly, with the increased number of recording heads 30 to 33 to be used, the image can accordingly be obtained at high speed. On the other hand, there is a possibility of accuracy decrease in the striking positions of the ink droplets 26 accompanying the increase in a population of the nozzles 42.

<First Example of High-Image-Quality Mode>

Figure 8:
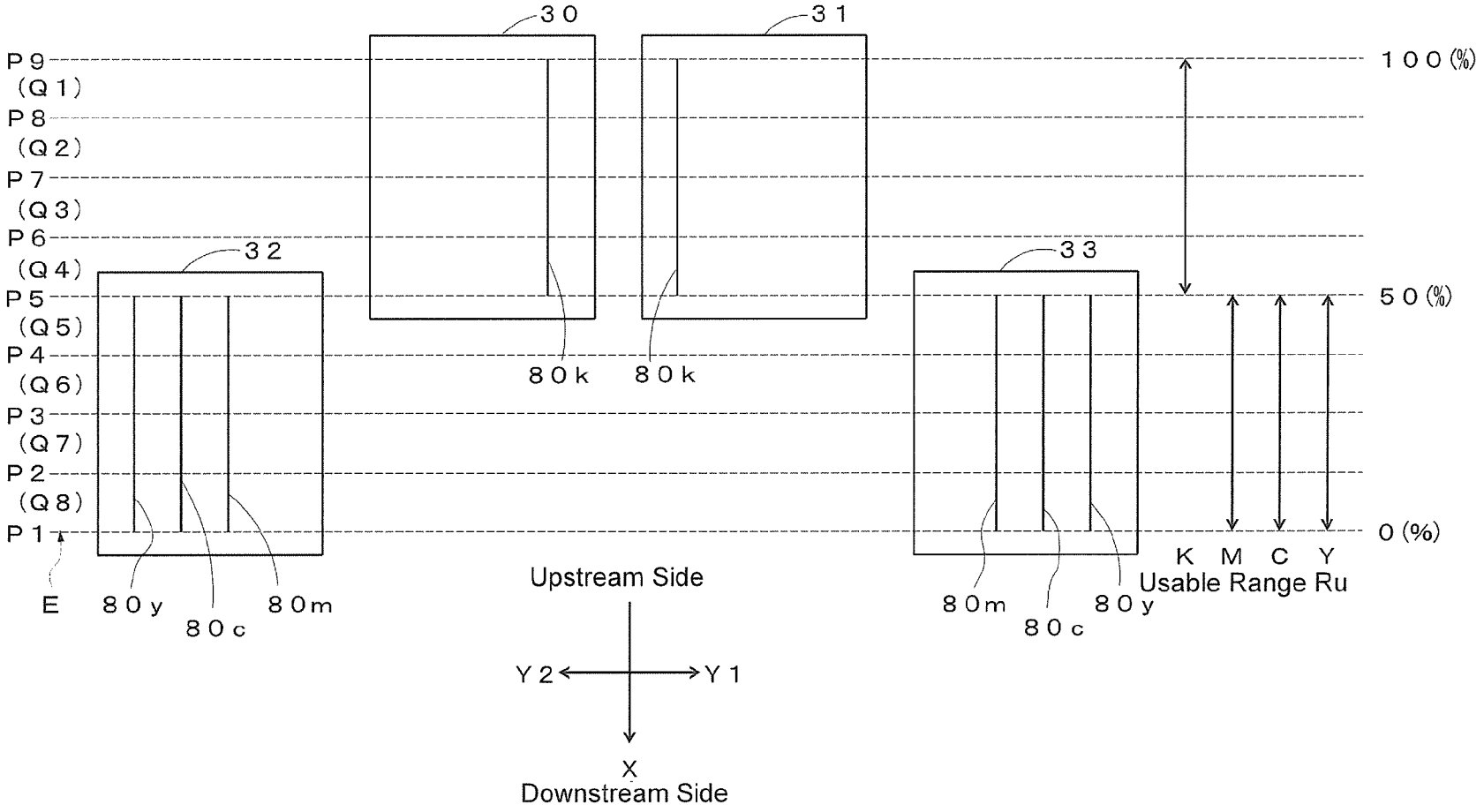
FIG. 8 is an explanatory diagram illustrating a usable range of the nozzles in a high-quality mode (first example).

FIG. 8 is an explanatory diagram illustrating the usable ranges Ru of the nozzles 42 in the high-quality mode (first example). In FIG. 8, similarly to FIG. 6, among the nozzle groups 46 of the respective colors, only the nozzle rows to be used 80*y*, 80*c*, 80*m*, 80*k* are illustrated by solid lines. The black usable range Ru is "50% to 100%", and the usable ranges Ru of the other three colors are each "0% to 50%". That is, in the first example, the nozzle row 28*k* of the recording head 30 (31) and the nozzle rows 28*m*, 28*c*, 28*y* of the recording head 32 (33) are used.

Here, in FIG. 8, the definitions of the recording edge E, the transfer position Pn (n=1 to 9), and the recording range Qn (n=1 to 8) are identical to those of FIG. 6, so the description thereof will be omitted. However, there is a difference in that the one-pass worth width (transfer pitch) is halved.

FIG. 9A to FIG. 9C are schematic diagrams illustrating the striking positions of the "black" ink droplets 26 in the high-quality mode (first example) for each pass. Specifically, FIG. 9A illustrates the accumulative striking positions in the 1st-pass transfer, FIG. 9B illustrates the accumulative striking positions in the 2nd-pass transfer, and FIG. 9C illustrates the accumulative striking positions in the 4th-pass transfer. Notably, the illustrated matrices have the same definition as that in FIG. 7A to FIG. 7C, so the description thereof will be omitted.

As shown in FIG. 9A, upon the 1st-pass transfer, the recording heads 30 to 33 sequentially discharge the ink droplets 26 to every other cell while moving in the Y-direction. In so doing, 16 ink droplets 26 discharged from the recording heads 30, 31 strike onto the respective positions in the matrix cells in the recording range Q1. After one scan along the Y-direction is completed, the recording medium 12 is transferred by one pass to the downstream side in the X-direction.

As shown in FIG. 9B, upon the 2nd-pass transfer, the recording heads 30 to 33 sequentially discharge the ink droplets 26 to every other cell while moving in the Y-direction. In so doing, 16 ink droplets 26 discharged from the recording heads 30, 31 strike onto the respective positions in the matrix cells in the recording range Q2. After one scan along the Y-direction is completed, the recording medium 12 is transferred by one pass to the downstream side in the X-direction.

Subsequently, upon the 3rd-pass transfer, the ink droplets 26 (16 droplets) discharged from the recording heads 30, 31 strike onto the respective positions in the matrix cells in the recording range Q3. Thereafter, upon the 4th-pass transfer, the ink droplets 26 (16 droplets) discharged from the recording heads 30, 31 strike onto the respective positions in the matrix cells in the recording range Q4. Due to this, all of the 64 cells are filled, and the image in the unit image region is completed.

As shown in FIG. 9C, the cells containing the two types of letters, namely "A", "B", are arranged evenly within the matrix. That is, in order to complete the image in the unit image region, only two recording heads 30, 31 are used.

FIG. 10A to FIG. 10C are schematic diagrams illustrating the striking positions of the "yellow" ink droplets 26 in the high-quality mode (first example) for each pass. Specifically, FIG. 10A illustrates the accumulative striking positions in the 5th-pass transfer, FIG. 10B illustrates the accumulative striking positions in the 6th-pass transfer, and FIG. 10C illustrates the accumulative striking positions in the 8th-pass transfer. In the 1st to 4th-pass transfers, the recording ranges Q1 to Q4 all do not overlap with the positions of the recording heads 32, 33, so there is not a single striking of the ink droplets 26.

As shown in FIG. 10A, upon the 5th-pass transfer, the recording heads 30 to 33 sequentially discharge the ink droplets 26 to every other cell while moving in the Y-direction. In so doing, 16 ink droplets 26 discharged from the recording heads 32, 33 strike onto the respective positions in the matrix cells in the recording range Q5. After one scan along the Y-direction is completed, the recording medium 12 is moved by one pass to the downstream side in the X-direction.

As shown in FIG. 10B, upon the 6th-pass transfer, the recording heads 30 to 33 sequentially discharge the ink droplets 26 to every other cell while moving in the Y-direction. In so doing, 16 ink droplets 26 discharged from the recording heads 32, 33 strike onto the respective positions in the matrix cells in the recording range Q6. After one scan along the Y-direction is completed, the recording medium 12 is moved by one pass to the downstream side in the X-direction.

Subsequently, upon the 7th-pass transfer, the ink droplets 26 (16 droplets) discharged from the recording heads 32, 33 strike onto the respective positions in the matrix cells in the recording range Q7. Thereafter, upon the 8th-pass transfer, the ink droplets 26 (16 droplets) discharged from the recording heads 32, 33 strike onto the respective positions in the matrix cells in the recording range Q8. Due to this, all of the 64 cells are filled, and the image in the unit image region is completed.

As shown in FIG. 10C, the cells containing the two types of letters, namely "C", "D", are arranged evenly within the matrix. That is, in order to complete the image in the unit image region, only two recording heads 32, 33 are used. Accordingly, with the decreased number of recording heads 30 to 33 to be used, time required for the image to be completed is thereby elongated. On the other hand, by selecting the nozzles 42 by decreasing the population thereof, the accuracy of the striking positions of the ink droplets 26 is improved.

Further, the usable ranges Ru of the respective colors may be determined so that the ink droplets 26 are discharged according to a particular color order at any positions on the recording medium 12. Here, the "particular color order" means a color order that is preliminary set for two, or three or more colors among the plurality of colors. In the first example, it should be noted that the discharge is reliably performed in the color order of "black→cyan", "black→yellow", "magenta→cyan", and "magenta→yellow".

Thus, in the case where the high-quality mode is designated, the head control section 66 may determine the usable range Ru having the same number of nozzles to be used for all of the dischargeable colors (CMYK), and perform the discharge control of the recording unit 38.

<Second Example of High-Image-Quality Mode>

Figure 11:
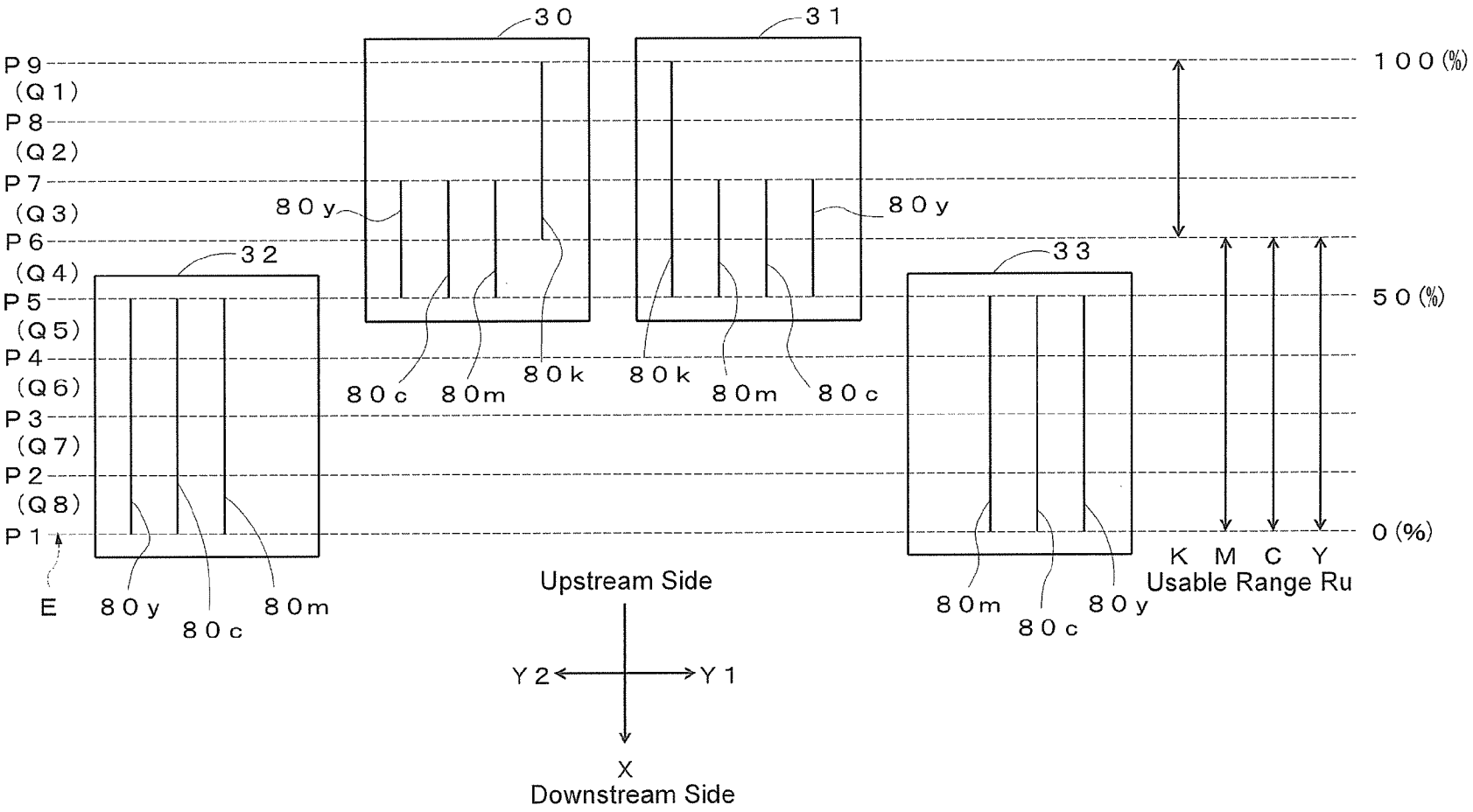
FIG. 11 is an explanatory diagram illustrating a usable range of the nozzles in a high-quality mode (second example).

FIG. 11 is an explanatory diagram illustrating the usable ranges Ru of the nozzles 42 in the high-quality mode (second example). The black usable range Ru is "62.5% to 100%", and the usable ranges Ru of the other three colors are each "0% to 75%". That is, in the second example, the nozzle rows 28*k*, 28*m*, 28*c*, 28*y* of the recording head 30 (31) and the nozzle rows 28*m*, 28*c*, 28*y* of the recording head 32 (33) are used.

Accordingly, in the case where the high-quality mode is designated, the head control section 66 may determine the usable ranges Ru in which the number of nozzles to be used differs at least for one color (K) among all of the dischargeable colors (CMYK), and perform the discharge control of the recording unit 38.

<Third Example of High-Image-Quality Mode>

Figure 12:
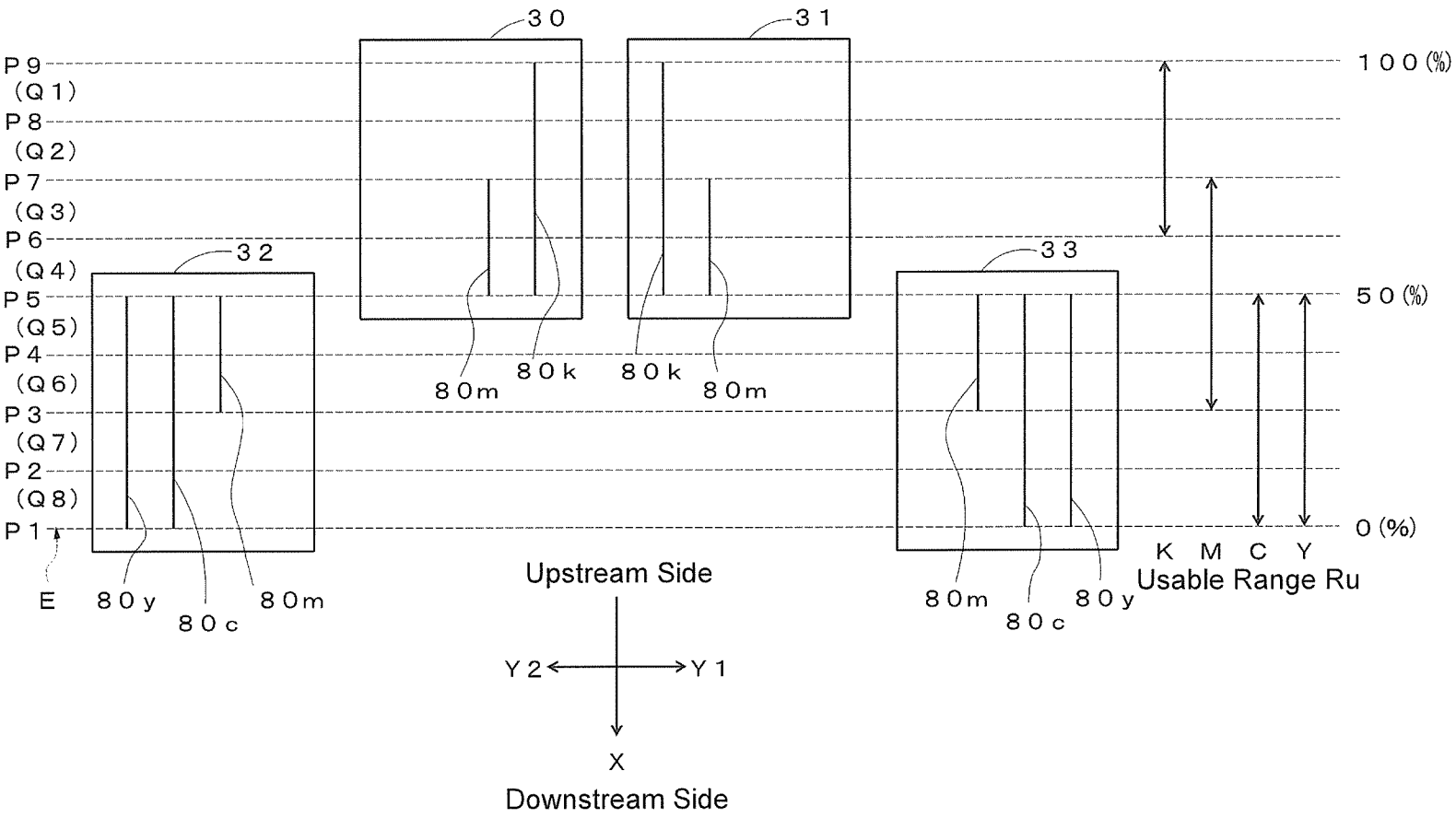
FIG. 12 is an explanatory diagram illustrating a usable range of the nozzles in a high-quality mode (third example).

FIG. 12 is an explanatory diagram illustrating the usable ranges Ru of the nozzles 42 in the high-quality mode (third example). The black usable range Ru is "50% to 100%", the magenta usable range Ru is "25% to 75%", and the usable ranges Ru of the other two colors are each "0% to 50%". That is, in the third example, the nozzle rows 28*k*, 28*m* of the recording head 30 (31) and the nozzle rows 28*m*, 28*c*, 28*y* of the recording head 32 (33) are used.

<Fourth Example of High-Image-Quality Mode>

Figure 13:
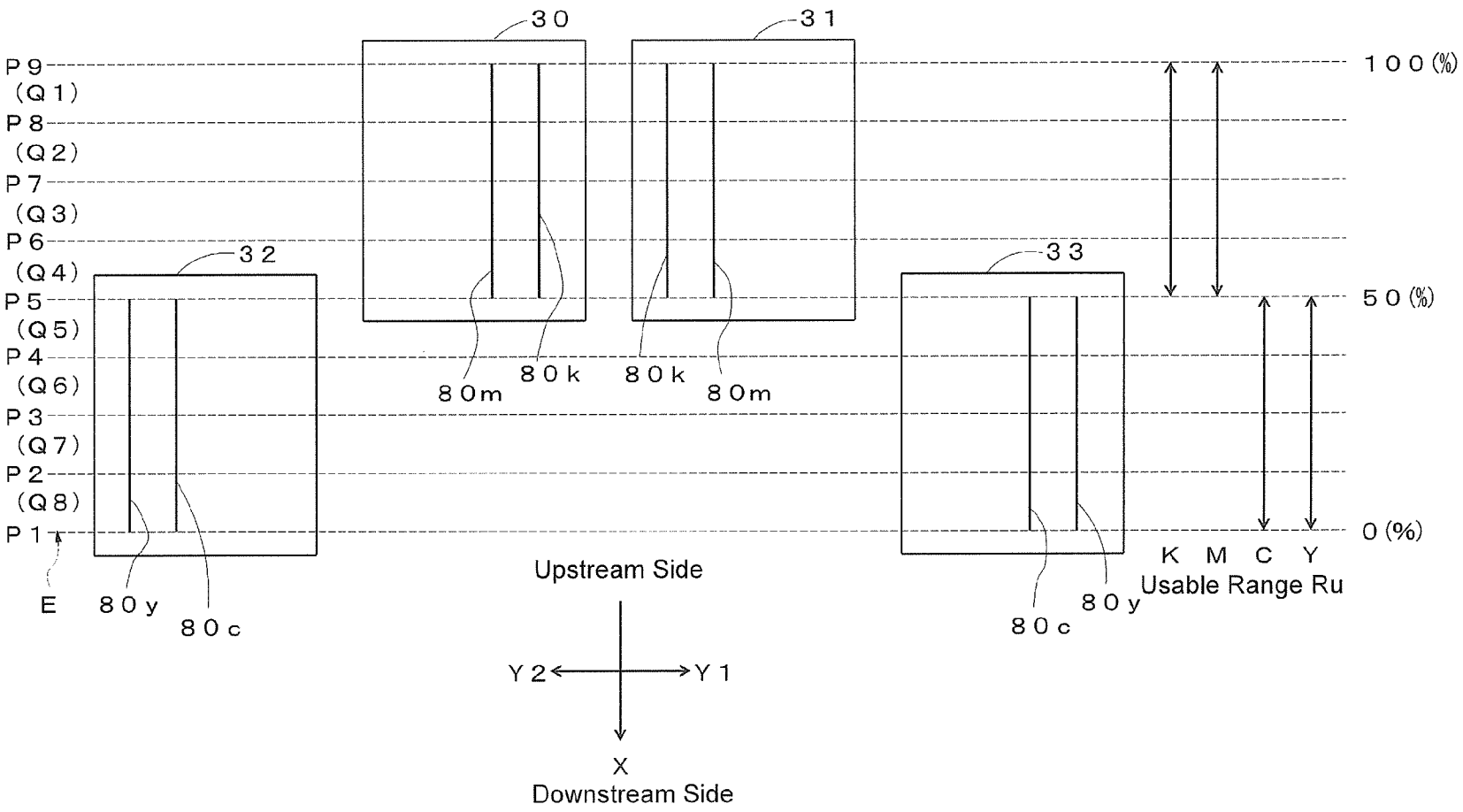
FIG. 13 is an explanatory diagram illustrating a usable range of the nozzles in a high-quality mode (fourth example).

FIG. 13 is an explanatory diagram illustrating the usable ranges Ru of the nozzles 42 in the high-quality mode (fourth example). The black usable range Ru is "50% to 100%", and the magenta usable range Ru is "50% to 100%". Further, the cyan usable range Ru is "0% to 50%", and the yellow usable range Ru is "0% to 50%". That is, in the fourth example, the nozzle rows 28*k*, 28*m* of the recording head 30 (31) and the nozzle rows 28*c*, 28*y* of the recording head 32 (33) are used.

<Fifth Example of High-Image-Quality Mode>

Figure 14:
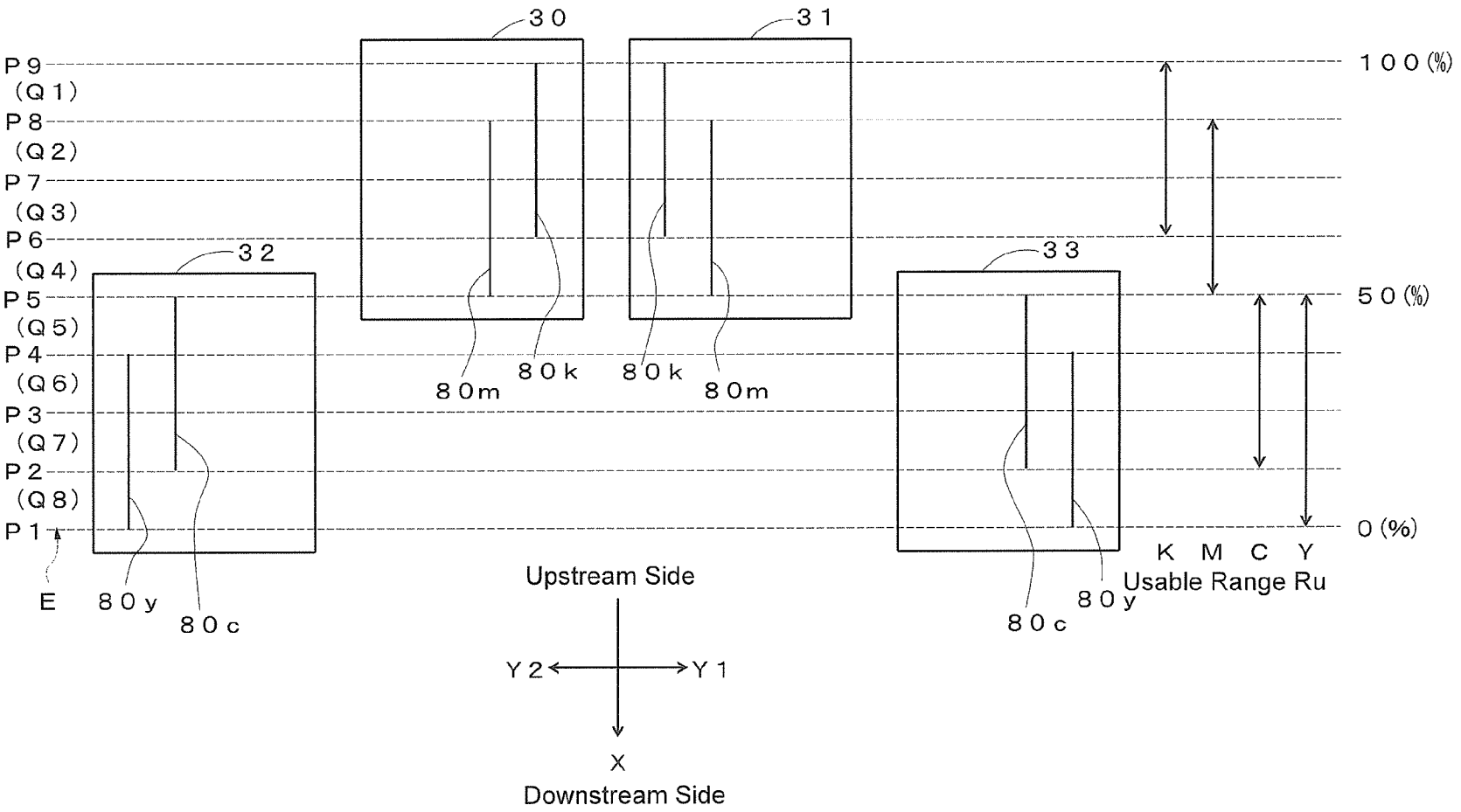
FIG. 14 is an explanatory diagram illustrating a usable range of the nozzles in a high-quality mode (fifth example).

FIG. 14 is an explanatory diagram illustrating the usable ranges Ru of the nozzles 42 in the high-quality mode (fifth example). The black usable range Ru is "62.5% to 100%", and the magenta usable range Ru is "50% to 87.5%". Further, the cyan usable range Ru is "12.5% to 50%", and the yellow usable range Ru is "0% to 37.5%". That is, in the fifth example, the nozzle rows 28*k*, 28*m* of the recording head 30 (31) and the nozzle rows 28*c*, 28*y* of the recording head 32 (33) are used.

As above, in the case where the high-quality mode is designated, the head control section 66 may determine the usable range Ru located on the lowermost stream side in the X-direction for the color with higher brightness (for example, yellow) than the brightness of at least one of the other colors, and cause the ink droplets 26 thereof to be discharged last. In a case of forming an image by layering dots on a recording medium 12, dots of the color with the relatively higher brightness are arranged in the uppermost layer of the image. In other words, by arranging dots of other colors with relatively high visibility at positions distant from the uppermost layer of the image, noise and granularity caused by the ink with high visibility becomes less conspicuous, and thus a high-quality image can be obtained.

<Sixth Example of High-Image-Quality Mode>

Figure 15:
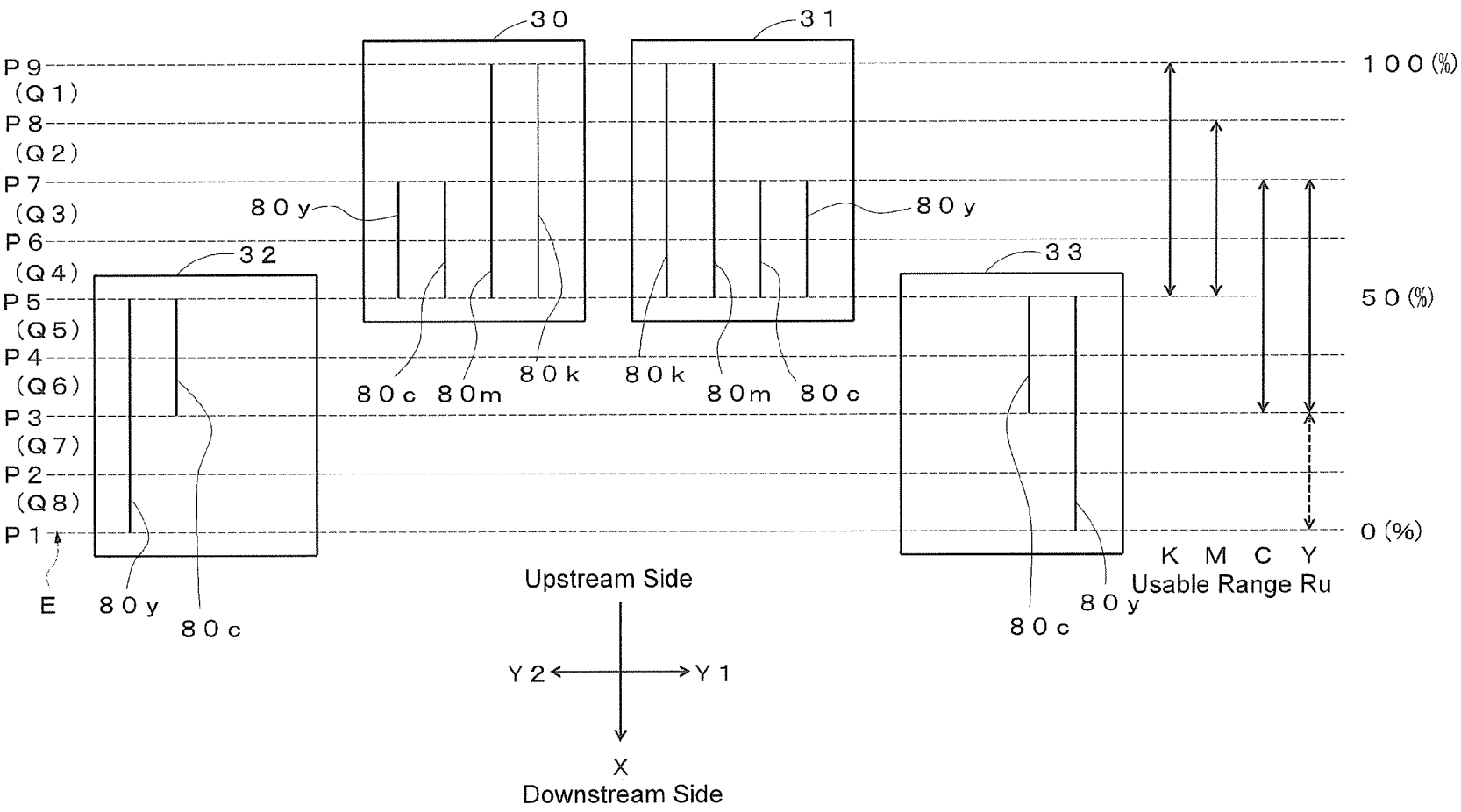
FIG. 15 is an explanatory diagram illustrating a usable range of the nozzles in a high-quality mode (sixth example).

FIG. 15 is an explanatory diagram illustrating the usable ranges Ru of the nozzles 42 in the high-quality mode (sixth example). The black usable range Ru is "50% to 100%", and the magenta usable range Ru is "50% to 100%". Further, the cyan usable range Ru is "25% to 75%", and the yellow usable range Ru is "0% to 75%". That is, in the sixth example, the nozzle rows 28*k*, 28*m*, 28*c*, 28*y* of the recording head 30 (31) and the nozzle rows 28*c*, 28*y* of the recording head 32 (33) are used.

Now, there is a tendency of banding (sub-scanning color streaks) caused by ink striking interference being less visible despite continuous discharge of the yellow ink droplets 26 with the highest brightness. Thus, if the irradiation time of the light source units 36, 37 differs for the outgoing pass and the returning pass of the bi-directional scanning after striking of the ink droplets 26, the discharge duty is set to be substantially constant in "0% to 25%" (recording ranges Q7, Q8) including the recording range where there is no range overlapping with other colors and where the ink striking will take place last, in order to suppress optical fringes generated in the recording ranges Q1 to Q6. By making the discharge duty substantially constant, state of the outermost surface of the image can be made uniform, and the optical fringes that may be generated between different passes can be reduced.

Notably, by making the discharge duty substantially constant, the banding may be generated on the image more easily. Thus, the visibility of the banding can be suppressed by using yellow, of which banding is not very visible. As a result, the banding on the image can be suppressed, and the optical fringes between different passes can be reduced.

[Effects of Inkjet Recording Device 10]

As above, the inkjet recording device 10 includes the recording unit 38 that is reciprocally movable along the Y-direction relative to the recording medium 12 and includes the plurality of nozzle rows 28 for discharging the ink droplets 26, the transfer rollers 18 that relatively moves the recording unit 38 and the recording medium 12 along the X-direction, the head control section 66 that performs the discharge control of the recording unit 38 while the transfer rollers 18 relatively move the recording unit 38 and the recording medium 12, and the mode designating section 64 that designates one of the plurality of recording modes including the "high-speed mode" and the "high-quality mode". Further, the recording unit 38 includes at least two nozzle groups 46 that discharge the ink droplets 26 of at least two colors.

The head control section 66 performs the discharge control by using all the nozzles 42 belonging to the nozzle groups 46 of respective colors as the usable range Ru in the case where the "high-speed mode" is designated by the mode designating section 64. On the other hand, in the case where the "high-quality mode" is designated, the head control section 66 determines, for each color, the usable range Ru being a part of the nozzle range Rn configured by the nozzle groups 46, and performs the discharge control using only the nozzles 42 belonging to the usable ranges Ru so as to cause the ink droplets 26 to be discharged according to the particular color order at any positions on the recording medium 12.

Further, in the inkjet recording method, the inkjet recording device 10 is used to perform [1] a designating step by the mode designating section 64, and perform [2] a controlling step by the head control section 66.

By the above configuration, in the case where the "high-speed mode" is designated, the total number of ink droplets 26 to be discharged is maximum while the recording unit 38 is moved once along the Y-direction. That is, the desired image is formed at high speed by designating the "high-speed mode" that uses the largest number of nozzles 42.

On the other hand, in the case where the "high-quality mode" is designated, such a design is enabled that both the population of the nozzles 42 of the same color and the positional relationship among the nozzles 42 of different colors in the X-direction are taken into account. That is, by designating the "high-quality mode" that uses part of the nozzles 42, a high-quality image is formed while microscopic physical phenomenon among the same color and different colors is taken into consideration.

Due to this, the "high-speed mode" or the "high-quality mode" can selectively be performed without requiring any process to change the configuration of the nozzle rows 28.

Further, the recording unit 38 includes at least three nozzle groups 46 of which positions in the Y-direction are different. Among the at least three nozzle groups 46, at least two nozzle groups 46 discharge the ink droplets 26 of the common color. With the center line C between the two lines formed by the nozzle groups 46 that are farthest away in the Y-direction as the reference, the nozzle group 46 closest to the center line C may discharge the ink droplets of the color (for example, black) with lower brightness than the brightness of the at least one other color, and the two nozzle groups 46 that are farthest away may discharge the ink droplets 26 of the color (for example, yellow) with higher brightness than the brightness of the at least one other color. By arranging the respective nozzle groups 46 as above, the ink droplets 26 of the color with relatively low brightness can be prevented from being discharged last at any position on the recording medium 12. As a result, the dots of the color with relatively high visibility are less likely to be arranged in the uppermost layer of the image, resulting in less noise and less granularity of the image.

Further, the recording unit 38 may be configured of the plurality of recording heads 30 to 33 arranged along the X-direction, and the recording heads 30, 32 (or recording heads 31, 33) may include nozzle rows 28 configuring the nozzle group 46, and may have the nozzle rows 28 that discharge the ink droplets 26 of at least two common colors and are arranged along the Y-direction in the common color order. By arranging the plurality of recording heads 30, 32 (or recording heads 31, 33) along the X-direction, the number of nozzles 42 to be provided in each of the recording heads 30 to 33 can be made less, resulting in improved productivity of the recording heads 30 to 33 (for example, yield).

Modified Example

Now, a modified example of the inkjet recording device 10 of the present embodiment will be described with reference to FIG. 16 and FIG. 17. Notably, for constituent features that are same as those in the embodiment, same reference signs are given and the description thereof will be omitted.

Figure 16:
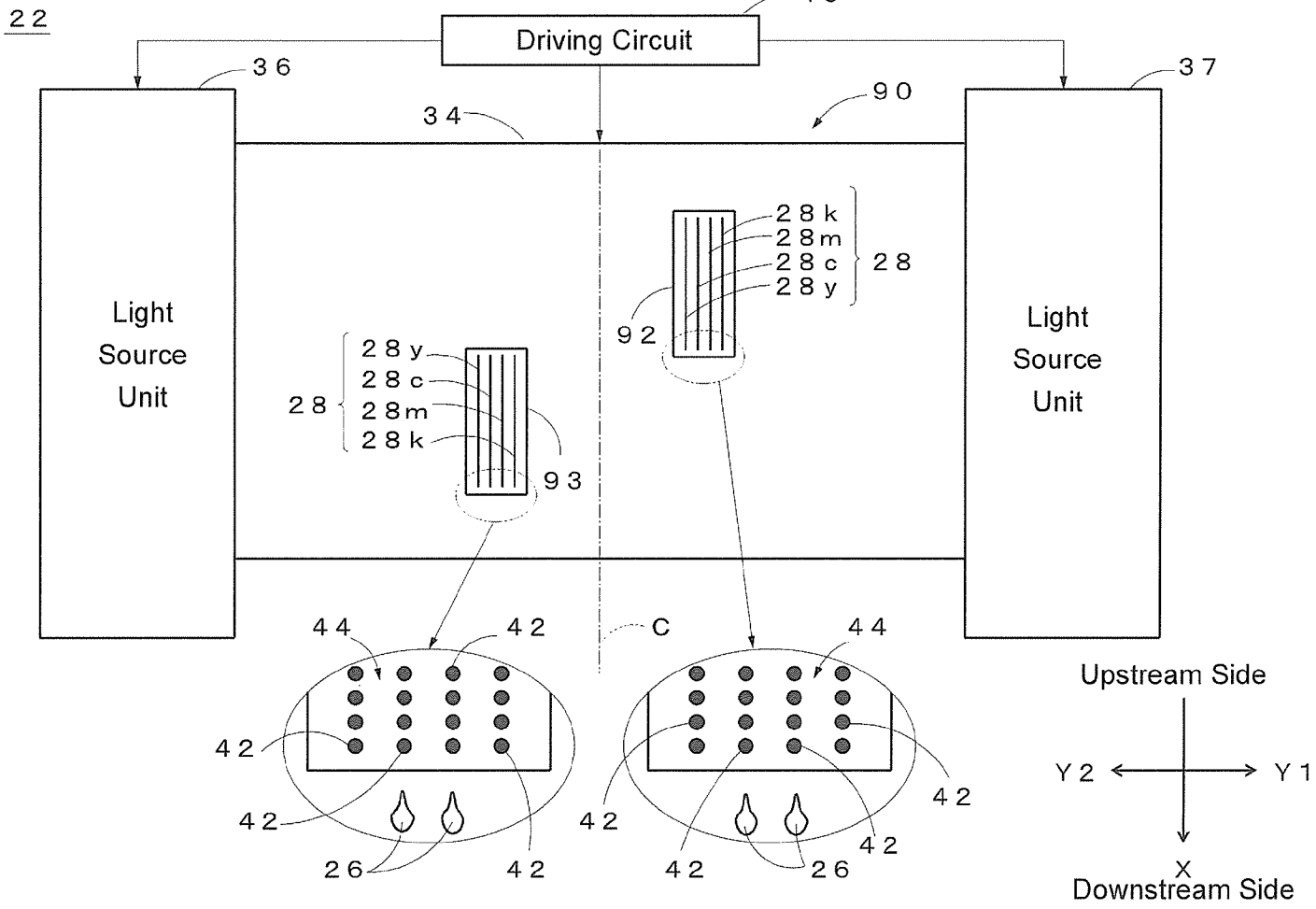
FIG. 16 is a schematic see-through plan view of a recording unit of a modified example.

FIG. 16 is a schematic see-through plan view of a recording unit 90 of the modified example. The recording unit 90 is configured of two recording heads 92, 93 that include nozzle rows 28, and a head holder 34 that retains the recording heads 92, 93. The recording heads 92, 93 each have four nozzle rows 28*y*, 28*c*, 28*m*, 28*k* arranged from their ends along the Y-direction.

Figure 17:
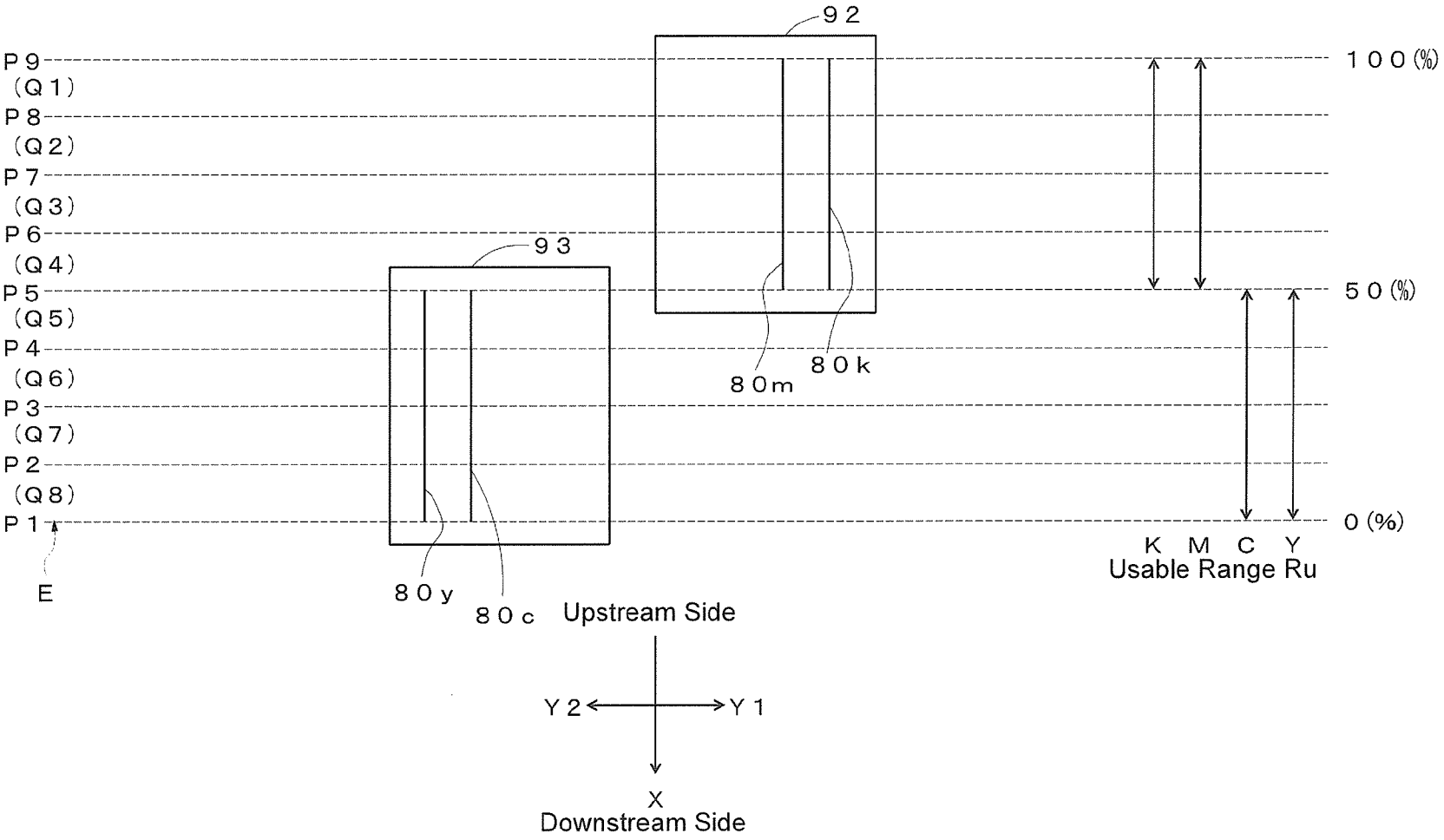
FIG. 17 is an explanatory diagram illustrating a usable range of the nozzles in a high-quality mode using the recording unit of FIG. 16.

FIG. 17 is an explanatory diagram illustrating usable ranges Ru of the nozzles 42 in the high-quality mode using the recording unit 90 of FIG. 16. The black usable range Ru is "50% to 100%", and the magenta usable range Ru is "50% to 100%". Further, the cyan usable range Ru is "0% to 50%", and the yellow usable range Ru is "0% to 50%". That is, in this modified example, the nozzle rows 28*k*, 28*m* of the recording head 30 (31) and the nozzle rows 28*c*, 28*y* of the recording head 32 (33) are used.

Thus, even if the recording heads 92, 93 having different configurations from those of the recording heads 30 to 33 are employed, the discharge is reliably performed in the particular color order of "black→cyan", "black→yellow", "magenta→cyan", and "magenta→yellow" similarly to the above embodiment (recording unit 38 of FIG. 3), and the high-quality image with reduced noise and reduced granularity can be obtained.

[Supplemental Remarks]

Notably, this disclosure is not limited to the aforementioned embodiment and modified examples, and it goes without saying that modifications can freely be made within the scope that does not go beyond the essence of this disclosure.

For example, the number of colors or color combination of the ink droplets 26 is not limited to the four colors of process colors (CMYK). Specifically, aside from W (white) and CL (clear), colors that are similar to the process colors (CMYK), and spot colors such as gold, silver, orange, violet, and the like may suitably be combined.

What is claimed is:

1. An inkjet recording device, comprising:

a recording unit that is reciprocally movable along a main-scanning direction relative to a recording medium, and the recording unit includes a plurality of nozzles for discharging ink droplets;

a moving mechanism that moves the recording unit and the recording medium relatively in a sub-scanning direction that is a direction intersecting the main-scanning direction;

a head control section that performs a discharge control of the recording unit while the moving mechanism relatively moves the recording unit and the recording medium; and a mode designating section that designates one of a plurality of recording modes different from the discharge control, and the plurality of recording modes including a first recording mode and a second recording mode, wherein when a set of two or more nozzles that are arranged along the sub-scanning direction and discharge ink droplets of a same color is defined as one nozzle group, the recording unit including at least two nozzle groups that discharge ink droplets of at least two colors, in a case where the first recording mode is designated by the mode designating section, the head control section performs the discharge control by using all of the nozzles belonging to the nozzle group of each color as a usable range, and in a case where the second recording mode is designated by the mode designating section, the head control section determines, for each color, a usable range being a part of a nozzle range configured by the nozzle group, and performs the discharge control by using only the nozzles belonging to the usable range, so that ink droplets are discharged at any positions on the recording medium according to a particular color order, wherein the recording unit includes at least two nozzle groups that discharge ink droplets of at least two colors with different brightness, the moving mechanism moves the recording unit and the recording medium relatively from an upstream side to a downstream side in the sub-scanning direction, and in a case where the second recording mode is designated, the head control section determines the usable range as being located on the uppermost stream side in the sub-scanning direction for a color with the lowest brightness, wherein the recording unit includes at least three nozzle groups with different positions in the main-scanning direction, at least two nozzle groups among the at least three nozzle groups discharge ink droplets of a common color, and with a center line between two lines formed by the nozzle groups that are farthest away in the main-scanning direction as a reference, the nozzle group close to the center line discharges the ink droplets of the color with lower brightness than the brightness of the at least one other color, and the two nozzle groups that are farthest away in the main-scanning direction discharge the ink droplets of the color with higher brightness than the brightness of the at least one other color.

2. The inkjet recording device according to claim 1, wherein the recording unit is configured by arranging a plurality of recording heads along the sub-scanning direction, and each of the recording heads includes nozzle rows configuring the nozzle group, and has the nozzle rows that discharge the ink droplets of at least two common colors and are arranged along the main-scanning direction in a common color order.

3. The inkjet recording device according to claim 2, wherein in the case where the second recording mode is designated, the head control section determines the usable range in nozzle row units for each color, and performs the discharge control.

4. The inkjet recording device according to claim 3, wherein in the case where the second recording mode is designated, the head control section uses only the nozzle row of the recording head positioned on the uppermost stream side in the sub-scanning direction to cause the ink droplets of the color with the lowest brightness to be discharged first.

5. The inkjet recording device according to claim 1, wherein in the case where the second recording mode is designated, the head control section determines the usable range positioned at the lowermost stream side in the sub-scanning direction for the color with the highest brightness so that the ink droplets of the color with the highest brightness are discharged last.

6. The inkjet recording device according to claim 1, wherein in the case where the second recording mode is designated, the head control section determines the usable range in which the number of available nozzles are the same for all of dischargeable colors, and performs the discharge control.

7. The inkjet recording device according to claim 1, wherein in the case where the second recording mode is designated, the head control section determines the usable range in which the number of available nozzles differs for at least one color among all of the dischargeable colors, and performs the discharge control.

8. The inkjet recording device according to claim 1, wherein the recording unit is configured by arranging a plurality of recording heads along the sub-scanning direction, and each of the recording heads includes nozzle rows configuring the nozzle group, and has the nozzle rows that discharge the ink droplets of at least two common colors and are arranged along the main-scanning direction in a common color order.

9. The inkjet recording device according to claim 8, wherein in the case where the second recording mode is designated, the head control section determines the usable range in nozzle row units for each color, and performs the discharge control.

10. The inkjet recording device according to claim 9, wherein in the case where the second recording mode is designated, the head control section uses only the nozzle row of the recording head positioned on the uppermost stream side in the sub-scanning direction to cause the ink droplets of the color with the lowest brightness to be discharged first.

11. The inkjet recording device according to claim 1, wherein in the case where the second recording mode is designated, the head control section determines the usable range positioned at the lowermost stream side in the sub-scanning direction for the color with the highest brightness so that the ink droplets of the color with the highest brightness are discharged last.

12. The inkjet recording device according to claim 1, wherein in the case where the second recording mode is designated, the head control section determines the usable range in which the number of available nozzles are the same for all of dischargeable colors, and performs the discharge control.

13. The inkjet recording device according to claim 1, wherein in the case where the second recording mode is designated, the head control section determines the usable range in which the number of available nozzles differs for at least one color among all of the dischargeable colors, and performs the discharge control.

14. The inkjet recording device according to claim 1, wherein in the case where the second recording mode is designated, the head control section determines the usable range in which the number of available nozzles are the same for all of dischargeable colors, and performs the discharge control.

15. The inkjet recording device according to claim 1, wherein in the case where the second recording mode is designated, the head control section determines the usable range in which the number of available nozzles differs for at least one color among all of the dischargeable colors, and performs the discharge control.

16. The inkjet recording device according to claim 1, wherein in the case where the second recording mode is designated, the head control section determines at least a part of the usable range for at least one color as being displaced in the sub-scanning direction and at least a part of the usable range for at least two colors as being overlapped with each other in the main-scanning direction.

17. The inkjet recording device according to claim 1, wherein the nozzle groups for discharging the ink droplets of the common color are disposed at equal distance from the center line.

18. An inkjet recording method in which an inkjet recording device is used, the inkjet recording device including: a recording unit that is reciprocally movable along a main-scanning direction relative to a recording medium, and the recording unit includes a plurality of nozzles for discharging ink droplets; and a moving mechanism that moves the recording unit and the recording medium relatively in a sub-scanning direction that is a direction intersecting the main-scanning direction, the inkjet recording device being configured to perform a discharge control of the recording unit while the moving mechanism relatively moves the recording unit and the recording medium, the recording unit including at least two nozzle groups when a set of two or more nozzles that are arranged along the sub-scanning direction and discharge ink droplets of a same color is defined as one nozzle group, wherein the inkjet recording method comprising:

a designating step of designating one of a plurality of recording modes different from the discharge control, and the plurality of recording modes including a first recording mode and a second recording mode; and a controlling step of in a case where the first recording mode is designated, performing the discharge control by using all of the nozzles belonging to the nozzle group of each color as a usable range and, in a case where the second recording mode is designated, determining, for each color, a usable range being a part of a nozzle range configured by the nozzle group, and performing the discharge control by using only the nozzles belonging to the usable range to cause ink droplets to be discharged at any positions on the recording medium according to a particular color order, wherein the recording unit includes at least two nozzle groups that discharge ink droplets of at least two colors with different brightness, the moving mechanism moves the recording unit and the recording medium relatively from an upstream side to a downstream side in the sub-scanning direction, and in a case where the second recording mode is designated, a head control section determines the usable range as being located on the uppermost stream side in the sub-scanning direction for a color with the lowest brightness, wherein the recording unit includes at least three nozzle groups with different positions in the main-scanning direction, at least two nozzle groups among the at least three nozzle groups discharge ink droplets of a common color, and with a center line between two lines formed by the nozzle groups that are farthest away in the main-scanning direction as a reference, the nozzle group close to the center line discharges the ink droplets of the color with lower brightness than the brightness of the at least one other color, and the two nozzle groups that are farthest away in the main-scanning direction discharge the ink droplets of the color with higher brightness than the brightness of the at least one other color.

* * * * *